US005184118A

United States Patent [19]

Yamazaki

[11] Patent Number: 5,184,118

[45] Date of Patent: Feb. 2, 1993

[54] LIQUID CRYSTAL DISPLAY APPARATUS AND METHOD OF DRIVING SAME

[75] Inventor: Katsunori Yamazaki, Suwa, Japan

[73] Assignee: Seiko Epson Corporation, Tokyo, Japan

[21] Appl. No.: 484,011

[22] Filed: Feb. 23, 1990

Related U.S. Application Data

[63] Continuation-in-part of Ser. No. 232,750, Aug. 15, 1988, Pat. No. 5,010,326.

[30] Foreign Application Priority Data

| | | | |
|---|---|---|---|
| Aug. 13, 1987 | [JP] | Japan | 62-202154 |
| Feb. 9, 1988 | [JP] | Japan | 63-27922 |
| Feb. 9, 1988 | [JP] | Japan | 63-27923 |
| Feb. 9, 1988 | [JP] | Japan | 63-27924 |
| Feb. 23, 1989 | [JP] | Japan | 1-43478 |

[51] Int. Cl.[5] ..... G09G 3/36

[52] U.S. Cl. ..... 340/784; 340/805; 359/55

[58] Field of Search ..... 340/765, 784, 805; 350/332, 333; 359/55, 84, 85

[56] References Cited

U.S. PATENT DOCUMENTS

| | | | |
|---|---|---|---|
| 4,485,380 | 11/1984 | Soneda et al. | 340/784 |
| 4,710,768 | 12/1987 | Takeda et al. | 340/805 |
| 4,845,482 | 7/1989 | Howard et al. | 340/805 |
| 4,864,290 | 9/1989 | Waters | 340/805 |
| 5,010,326 | 4/1991 | Yamazaki | 340/805 |

FOREIGN PATENT DOCUMENTS

| | | |
|---|---|---|
| 0211599 | 2/1987 | European Pat. Off. . |
| 60-19195 | 1/1985 | Japan . |
| 60-19196 | 1/1985 | Japan . |
| 62-31825 | 2/1987 | Japan . |

*Primary Examiner*—Jeffery A. Brier
*Attorney, Agent, or Firm*—Blum Kaplan

[57] ABSTRACT

A liquid crystal display apparatus applying scanning voltage waveforms to a plurality of scanning electrodes and signal voltage waveforms to a plurality of signal electrodes and periodically inverting the polarity of the voltage difference between the electrodes. In providing a display having even contrast, the scanning voltage waveforms applied to the scanning electrodes and/or the signal voltage waveforms applied to the signal electrodes are changed immediately after the polarity of the voltage difference is inverted.

21 Claims, 24 Drawing Sheets

SIGNAL DIN

H
L
T
SIGNAL LP

H
L
T
SIGNAL FR

H
L
T
SIGNAL XSCL

H
L
T
DATA SIGNALS

H
L
T 102
103
SIGNAL XSCL
SIGNAL LP
SIGNAL FR
104
COUNTER CIRCUIT
401
FIRST COUNTER HOLDING CIRCUIT
402
404
VALUE ARITHMETIC CIRCUIT
403
SECOND COUNTER HOLDING CIRCUIT
405
CONTROL CIRCUIT
108
109

LIQUID CRYSTAL DISPLAY APPARATUS AND METHOD OF DRIVING SAME

CROSS-REFERENCE TO RELATED APPLICATIONS

This application is a continuation-in-part of U.S. patent application Ser. No. 07/232,750 (the '750 application), filed Aug. 15, 1988, now U.S. Pat. No. 5,010,326.

BACKGROUND OF THE INVENTION

This invention relates to a liquid crystal display device and, in particular, to a liquid crystal display device and method of driving the display which provides a uniform display with improved contrast.

A known method of driving a liquid crystal display device is the voltage averaging method shown in FIGS. 17, 18(*a*)–18(*c*) and 19(*a*). A matrix display liquid crystal cell, shown in FIG. 17, includes a liquid crystal panel 1 having a layer of liquid crystal material disposed between an upper substrate 2 and a lower substrate 3. A plurality of parallel spaced apart scanning electrodes Y1 to Y6 are disposed on the interior surface of substrate 2 in a lateral direction, and a plurality of parallel spaced apart signal electrodes X1 to X6 are disposed on the interior surface of substrate 3. The intersections of scanning electrodes Y1 to Y6 and signal electrodes X1 to X6 form display elements which may be lit, as depicted with diagonal lines in FIG. 17, or unlit, which are shown with unshaded lines. A liquid crystal display generally has more display elements than the 6×6 matrix shown for explanatory purposes in FIG. 17.

Selective voltages or non-selective voltages are applied sequentially to scanning electrodes Y1 to Y6. Scanning electrodes which are impressed with selective voltages are known as selected scanning electrodes. The period for which the particular voltage sequence is applied is known as one frame.

As the selective or non-selective voltages are applied in the particular order to scanning electrodes Y1 through Y6, lighting (lit) or non-lighting (non-lit) voltages are simultaneously applied to signal electrodes X1 to X6. A display element becomes lit if the corresponding scanning electrode is selected and a lighting voltage is impressed on the corresponding signal electrode. If a non-lighting voltage is impressed on the signal electrode, the intersection of the signal electrode and the selected scanning electrode is an unlit display element.

FIGS. 18(*a*)–18(*c*) and 19(*a*)–19(*c*) show the waveform of voltages applied to a pair of display elements D24 and D23 in FIG. 17,respectively. FIGS. 18(*a*) and 19(*a*) show the waveform of the signal voltage applied to signal electrode X2. FIG. 18(*b*) illustrates the waveform of the scanning voltage applied to scanning electrode Y4 and FIG. 19(*b*) illustrates the waveform of the scanning voltage applied to scanning electrode Y3. FIG. 18(*c*) depicts the waveform of the resulting voltage applied to display element D24 (a lit state) at the intersection of the signal electrode X2 and the scanning electrode Y4, and FIG. 19(*c*) depicts the waveform of the resulting voltage applied to the display element D23 (an unlit state) at the intersection of the signal electrode X2 and the scanning electrode Y3.

In FIGS. 18(*a*)–18(*c*) and 19(*a*)–19(*c*), F1 and F2 represent frame periods.

In frame period F1:

selective voltage=V0, non-selective voltage=V4
lighting voltage=V5, non-lighting voltage=V3

In frame period F2:

selective voltage=V5, non-selective voltage=V1
lighting voltage=V0, non-lighting voltage=V2.

Further, the following relationships are established:

$$V0-V1=V1-V2=V$$

$$V3-V4=V4-V5=V$$

$$V0-V5=n\cdot V,$$

when n is a constant. Alternating current is used in the driving process so that the voltages vary in polarity from period F1 to F2. The time required to invert the polarity is known as polarity inverting time.

As seen from a comparison of FIGS. 18(*a*)–18(*c*) and 19(*a*)–19(*c*), a display element with a corresponding selected scanning electrode is either lit or unlit depending on whether the voltage applied to the corresponding signal electrode is a lighting (selecting) voltage or a non-lighting (non-selecting) voltage. This driving method is known as the voltage averaging method.

The voltage averaging method is less than completely satisfactory because clear-cut rectangular waveforms are not in fact applied to the display dots elements for several reasons. First, the display element has an electrical capacitance determined by its area, the thickness of the liquid crystal layer and the dielectric constant of the liquid crystal material. Second, both the scanning and signal electrodes are made of transparent conductive films with a typical sheet resistance of several tens of ohms, which implies that the electrodes have a constant electric resistance.

Accordingly, while the voltages generated by the driving circuit may have the clear-cut rectangular waveforms of FIGS. 18(*a*)–18(*c*) and 19(*a*)–19(*c*), the waveforms become unevenly distorted by the time the voltages are actually applied to the display elements. Thus, there may be an undesired difference between adjoining display elements in the effective waveform of voltages applied thereto, which in turn leads to the problem of uneven contrast.

Another driving method, known as a line inversion driving method, has been proposed to overcome the uneven contrast associated with the voltage averaging method. Disclosed in Japanese Patent Laid-Open Publication Nos. 62-31825, 60-19195 and 60-19196, the line inversion driving method involves inverting the polarity of the voltage applied to the liquid crystal panel multiple times during one frame.

FIGS. 20(*a*)–20(*c*and 21(*a*)–21(*c*) are waveforms utilized in the line inversion driving method. FIG. 20(*a*) is the waveform of signal voltage applied to signal electrode X2 of FIG. 17 and FIG. 20(*b*) is the waveform of scanning voltage applied to scanning electrode Y2. The difference between these two waveforms applied to display element D22 formed by the intersection of signal electrode X2 and scanning electrode Y2 is shown in FIG. 20(*c*). Similarly, FIGS. 21(*a*) to 21(*c*) illustrate the waveform of signal voltage applied to signal electrode X2, the waveform of scanning voltage applied to scanning electrode Y3, and the difference between these two waveforms supplied to display element D23.

As is the case in the voltage averaging method, the line inversion driving method is also less than completely satisfactory. This is due to the fact that the density or contrast of a display element on the scanning electrode to which the selective voltage is applied immediately after inverting the polarity of the voltage applied differs from that of the display elements along other scanning electrodes. For this reason, the linear contrast is uneven. When the line inversion drive method is utilized the position of the scanning electrode undergoing polarity inversion varies with time and a stream of uneven linear contrast appears. This phenomenon in turn causes a considerable decline in the quality of the display of the liquid crystal display device.

Two causes have been determined to explain the uneven linear contrast associated with these prior art liquid crystal driving methods. These causes are as follows, referring to the display mode of FIG. 17 and the waveform of FIG. 21(*c*) as an example. For explanatory convenience, scanning electrodes Y1 to Y6 are arranged such that after the selection sequence from first scanning electrode Y1 to sixth scanning electrode Y6 is complete, the sequence returns to and repeats scanning from electrode Y1. Also for the example, a polarity inversion based on the line inversion driving method occurs between scanning electrodes Y3 and Y4, although in actuality there may be any number and location of polarity inversions effected.

Liquid crystal display panel 1 provides a so-called positive display wherein the contrast increases as an effective voltage applied to the display element rises. Assuming that V is the absolute value of the difference between the non-selecting voltage and the lighting/non-lighting voltage and n·V is the absolute value of the difference between the selecting voltage and the lighting voltage, where n is a constant typically having a value between 3 and 50.

The voltage waveform actually applied to display element D23 is illustrated in FIG. 22, drawn with a solid line 23. Waveform 23 is formed by a combination of voltage applied to signal electrode X2 and scanning electrode Y3 on the basis of signal electrode X3 in the display element matrix of FIG. 17. The voltage waveform indicated by a broken line 23*a* represents the voltage applied to scanning electrode Y2 based on signal electrode X2. As can be seen by comparing the waveform of FIG. 21(*c*) and waveform 23 drawn with the solid line in FIG. 22, the waveform of voltage actually applied to display element D23 is larger than the voltage applied to signal electrode X2 and scanning electrode Y3.

The reasons for this increase are as follows. Signal voltage waveform 23*a* indicated by the broken line in FIG. 22 is applied to display element D22. Hence, when the selection shifts from scanning electrode Y2 to electrode Y3, an electric charge amounting to $Q_1$ is discharged by the capacitor created by display element D22. $Q_1$ is waveform 23*a* indicated by the broken line in FIG. 22 and is expressed as follows:

$$Q_1 = nVC - (-VC) = (n+1)\ VC,$$

where C is the capacitance of the capacitor. The electric charge quantity $Q_2$ absorbed by display element 23 is expressed as follows:

$$Q_2 = (n-2)\ VC - VC = (n-3)\ VC$$

Hence, the difference $\Delta Q$ between $Q_1$ and $Q_2$ is given by:

$$\Delta Q = 4VC$$

As shown in FIG. 17 display elements D22 and D23 are next to each other and form electrically-connected capacitors with a low-valued resistance of the shorter signal electrode, which in this case is X3 (generally, 1 mm or less). Therefore, an electric charge, expressed as $Q_1 - \Delta Q = (n-3)\ VC$, immediately flows from display element D22 to display element D23, resulting in almost no voltage drop between the two elements.

However, an electric charge of $\Delta Q$ flows from scanning electrodes Y2 and Y3 or an end of signal electrode X3 (i.e., from outside into a portion to which the voltage is to be applied). When Q is flowing, the resistance of the scanning electrode and the signal electrode is considerably larger, even though the electrodes depend on the location of the display elements. As a result, the flow of electric charge is hindered. Because the electric charge is not easily discharged, even the voltage on signal electrode X3 is forced to drop when the voltage on scanning electrode Y2 falls from the level of selecting voltage to a non-selecting voltage. Accordingly, the effective voltage between signal electrode X3 and scanning electrode Y3 increases.

In other words, if the difference between charge/discharge quantities before and after the progression is positive, the effective value of the voltage applied to the display element on the next scanning electrode increases. Likewise, if the difference is negative, the effective value decreases. The magnitude of the effective value varies depending on the absolute value of the charge/discharge quantity. Charge/discharge quantities before and after the progression are routinely calculated.

Assume K is the number of all display elements on a particular scanning electrode, $N_{ON}$ is the number of lit elements, and $N_{OFF}$ is the number of unlit elements. Thus, display element number K is as follow:

$$K = N_{ON} + N_{OFF}$$

Assume $M_{ON}$ is the number of lit elements on the next scanning electrode, and $M_{OFF}$ is the number of unlit elements.

Assume $C_{ON}$ is the capacitance of the capacitor formed by the lit element and assume $C_{OFF}$ is the capacitance of the capacitor formed by the unlit element. Then, the relationship therebetween is expressed such as:

$$C_{ON} > C_{OFF}$$

All display elements on the selected scanning electrode are charged with the electric charge quantity $Q_1$ given by:

$$Q_1 = N_{ON} n\ VC_{ON} + N_{OFF}(n-2)\ VC_{OFF}$$

The display elements on the next selected scanning electrode are charged with the electric charge quantity $Q_2$ given by the formula:

$$Q_2 = M_{ON}\ n\ VC_{ON} + M_{OFF}(n-2)\ VC_{OFF}$$

Accordingly, the difference between electric charge quantities $Q_1$ and $Q_2$ is obtained as follows:

$$\begin{aligned}\Delta Q &= Q_1 - Q_2 \\ &= (N_{ON} - M_{ON})\, n\, VC_{ON} + \\ &\quad (N_{OFF} - M_{OFF})\,(n-2)\, VC_{OFF}\end{aligned}$$

since $N_{OFF}=K-N_{ON}$ and $M_{OFF}=K-M_{on}$, therefore $$\Delta Q=(N_{ON}-M_{ON})\,\{n\,(C_{ON}-C_{OFF})+2\,C_{OFF}\}\,V$$

Assume I is the difference given by $(N_{ON}-M_{ON})$, and $B=\{n\,(C_{ON}-C_{OFF})+2\,C_{OFF}\}\,v$. The result is:

$$\Delta Q=I\cdot B \qquad \text{(b 1)}$$

The polarity of the waveform then inverts simultaneously as the selection shifts, so that the display elements on the selected scanning electrode are charged with the electric charge quantity Q given by:

$$Q_1=N_{ON}n\, VC_{ON}+N_{OFF}\,(n-2)\, VC_{OFF}$$

The next scanning electrode is then selected. With the inverted polarity, the display elements on the selected scanning electrode are charged with the electric charge quantity $Q_2$ given by:

$$Q_2=-(M_{ON}n\, VC_{ON}+M_{OFF}\,(n-2)\, VC_{OFF})$$

The difference Q between $Q_1$ and $Q_2$ is expressed by:

$$\begin{aligned}-Q &= Q_1 - Q_2 \\ &= N_{ON}\, n\, VC_{ON} + N_{OFF}\,(n-2)\, VC_{OFF} + \\ &\quad M_{ON}\, n\, VC_{ON} + M_{OFF}\,(n-2)\, VC_{OFF} \\ &= (N_{ON} + M_{ON})\, n\, VC_{ON} + \\ &\quad (N_{OFF} + M_{OFF})\,(n-2)\, VC_{OFF}\end{aligned}$$

where $N_{OFF}=K-N_{On}$ and $M_{OFF}=K-M_{ON}$, so that $$\begin{aligned}-Q &= (N_{ON} + M_{ON})\, n\, VC_{ON} + \\ &\quad (2K - N_{ON} - M_{ON})\,(n-2)\, VC_{OFF} \\ &= (N_{ON} + M_{ON})\,\{n\,(C_{ON} - C_{OFF}) + \\ &\quad 2C_{OFF}\}\, V + 2k\,(n-2)\, VC_{OFF}\end{aligned}$$

Assume F is the sum of $(N_{ON}+M_{ON})$, and $D=2K\,(n-2)\,VC_{OFF}$. The result is:

$$-Q=F\cdot B+D$$

Therefore, taking the polarity inversion into consideration, the electric charge quantity difference is expressed as:

$$\Delta Q=-F\cdot B-D \qquad (2)$$

It follows from formulae (1) and (2) that the difference I becomes positive when the number of lit elements on the scanning electrode selected is greater than that of lit elements on the subsequently scanned scanning electrode during a selective shift with no polarity inversion, resulting in display elements on the subsequently selected scanning electrode having higher density because of the increased effective voltage. In contrast, if the number of lit elements in the subsequent scanned scanning electrode is larger than that of the scanning electrode prior to the selective shift, the difference I becomes negative, resulting in display elements on the subsequently scanned scanning electrode having a lower density because of the decreased effective voltage. These fluctuations correspond to the absolute value of I.

During a selective shift with polarity inversion, the effective voltage impressed across the display elements on the subsequently scanned scanning electrode invariably diminishes by a constant value. At the same time, the effective voltage decreases by a value corresponding to the difference in F before and after the selective shift.

In other words, the unevenness in contrast corresponds to the difference I between the numbers of lit elements before and after a selective shift with no polarity inversion, whereas if polarity inversion occurs during the selective shift, the unevenness in contrast corresponds both to the difference in the number of lit elements before and after the selective shift as well as to the regular contrasting unevenness.

This first cause of contrast unevenness resulting from a selective shift with polarity inversion is the subtle difference produced during the step of changing the polarity between the signal and scanning voltage waveforms outputted by the actual driving circuit.

The selective voltage is impressed just before inverting the polarity. The magnitude of the voltage of each signal electrode corresponding to a non-selective scanning electrode changes immediately after the inversion has been effected to correspond to the electric charge quantity obtained from formula (2). This change in the magnitude of the voltage is dragged (i.e., lags, does not change instantaneously) on the side of the selective voltage after the polarity inversion.

This phenomenon is shown in FIGS. 23, 24(*a*)–24(*c*) and 25(*a*). FIG. 23 illustrates liquid crystal panel 1 identical with that of FIG. 17 but with a different display contents. FIGS. 24(*a*)–24(*c*and 25(*a*) illustrate voltage waveforms for display elements D33 and D43 shown in FIG. 23, respectively. FIG. 24(*a*) is the voltage waveform applied to signal electrode X3, FIG. 24(*b*) is the voltage waveform for scanning electrode Y3, and FIG. 24(*c*) is the waveform of voltage applied across a display element D33 formed at the intersection of signal electrode X3 and scanning electrode Y3. Similarly, FIG. 25(*a*) is the voltage waveform applied to signal electrode X4, FIG. 25(*b*) is the voltage waveform applied to scanning electrode Y3, and FIG. 25(*c*) shows a voltage waveform applied to an adjacent display element D43 formed at the intersection of signal electrode X4 and scanning electrode Y3.

Characteristic of what occurs when a lighting voltage is applied to a signal electrode, the lighting voltage lags on the side of the selecting voltage just after the polarity inversion, as illustrated in FIG. 24(*a*). Eventually the effective voltage applied across display element D33 decreases to a degree coinciding with the lag, as shown in FIG. 24(*c*). When a non-lighting voltage is applied to a signal electrode, the non-lighting voltage also lags on the side of the selecting voltage, as illustrated in FIG. 25(*a*). Eventually the effective voltage impressed on display element D43 increases to a degree coinciding with the lag, as shown in FIG. 25(*c*). For this reason, lit element D33 has less display contrast than other lit display elements, whereas unlit element D43 becomes more visible than other unlit display elements.

The unevenness on the display is proportional to the electric charge given by formula (2).

The second cause of the contrasting unevenness is the unevenness corresponding to the display contents on the liquid crystal panel.

Uneven contrast in the liquid crystal display can be minimized (such as disclosed in the '750 application) by compensating the scan voltage waveform and/or signal voltage waveform according to the characters or patterns produced on the liquid crystal display. Uneven contrast caused by differences in the shades of gray of the picture elements associated with the first and last scanning electrodes compared to the picture elements associated with the scanning electrodes therebetween can be minimized by applying appropriate compensating voltages to the picture elements. Neither compensation technique, however, addresses unevenness in contrast occurring immediately after the polarity of the voltage applied to the liquid crystal panel has been inverted.

Accordingly, it is desirable to provide a liquid crystal display apparatus which counteracts these causes of uneven contrast in the prior art liquid crystal display devices and, in particular, immediately after the polarity of the voltage applied to the liquid crystal panel has been inverted.

SUMMARY OF THE INVENTION

Generally speaking, in accordance with the invention, a liquid crystal display device having a plurality of picture elements which can be lit and unlit to produce a pattern to be displayed includes a first substrate including a group of scanning electrodes disposed thereon; a second substrate spaced apart from said first substrate and including a group of signal electrodes disposed thereon and liquid crystal material in the space between the substrate. The device includes driving circuitry for driving the device by providing scan voltage waveforms to the scanning electrodes and providing signal voltage waveforms to the signal electrodes to thereby apply voltages across the picture elements. The driving circuitry periodically inverts the polarity of voltages applied to the picture elements and immediately following polarity inversion varies the voltage level of at least one of the scan voltage waveforms and signal voltage waveforms which is associated with at least one of the picture elements.

The unevenness in contrast occurring immediately after polarity inversion of a voltage applied to the liquid crystal panel is minimized by providing compensating voltages to the scanning and/or signal electrodes immediately following polarity inversion.

As used herein, the periodic inversion of polarity of a voltage applied across a picture element refers to switching the polarity of the voltage applied across a picture element from one frame to the next frame.

Variation in the voltage level in the scan voltage waveform and/or signal voltage waveform is based on the number of lit picture elements associated with a first scanning electrode to which a selecting voltage has been applied immediately before the polarity inversion and the number of lit picture elements on a second scanning electrode to which a selecting voltage is applied immediately following polarity inversion.

The scan voltage waveforms include selecting and non-selecting voltages which are provided to the scanning electrodes. In one preferred embodiment, variation in the non-selecting voltages applied to the scanning electrodes occurs immediately following polarity inversion. In this case, the selecting voltage is applied immediately before polarity inversion. Variation in the non-selecting voltage is also based on the number of lit picture elements on the scanning electrode to which the selecting voltages have been applied immediately before polarity inversion and the number of lit picture elements on the scanning electrode to which the selecting voltage is applied immediately after polarity inversion.

Accordingly, it is an object of the invention to provide an improved liquid crystal display device which substantially reduces the unevenness in the contrast of the display.

It is another object of the invention to provide an improved liquid crystal display device which corrects distortions of the scanning voltage waveforms and/or signal voltage waveforms based on the pattern or characters to be displayed by the liquid crystal display device.

It is further object of the invention is to provide an improved liquid crystal display device which reduces fluctuations in the effective voltages applied to the picture elements based on cross-talk.

Still other objects and advantages of the invention will, in part, be obvious and will, in part, be apparent from the specification.

The invention accordingly comprises a device possessing the features, properties, and the relation of components which will be exemplified in the device hereinafter described, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

The following illustrative embodiments in accordance with the invention are set forth for purposes of illustration and are not presented in a limiting sense. Embodiments 1–5 are examples of liquid crystal display devices which overcome the problem of uneven display contrast due to cross-talk. Embodiments 6–10 are examples of liquid crystal display devices in accordance with the invention which overcome the problem of uneven display contrast due to the display contents.

EMBODIMENT 1

The unevenness in contrast is, irrespective of display pattern, caused to a degree when the polarity of the voltage applied to a display element is inverted. As discussed above, additional unevenness corresponds to a sum F of the number of lit elements on a scanning electrode scanned just before and immediately after the polarity inversion.

When the scanning electrode selected during an operation other than the polarity inversion shifts to the next electrode, the waveform applied to the display elements is distorted in accordance with the difference I between the number of lit display elements on the selected scanning electrode and the number of lit dots on a subsequently selected electrode. Hence, waveform corrections corresponding to the sum F and the difference I may be performed after these values are calculated during an operation of the liquid crystal display device.

Figure 1:
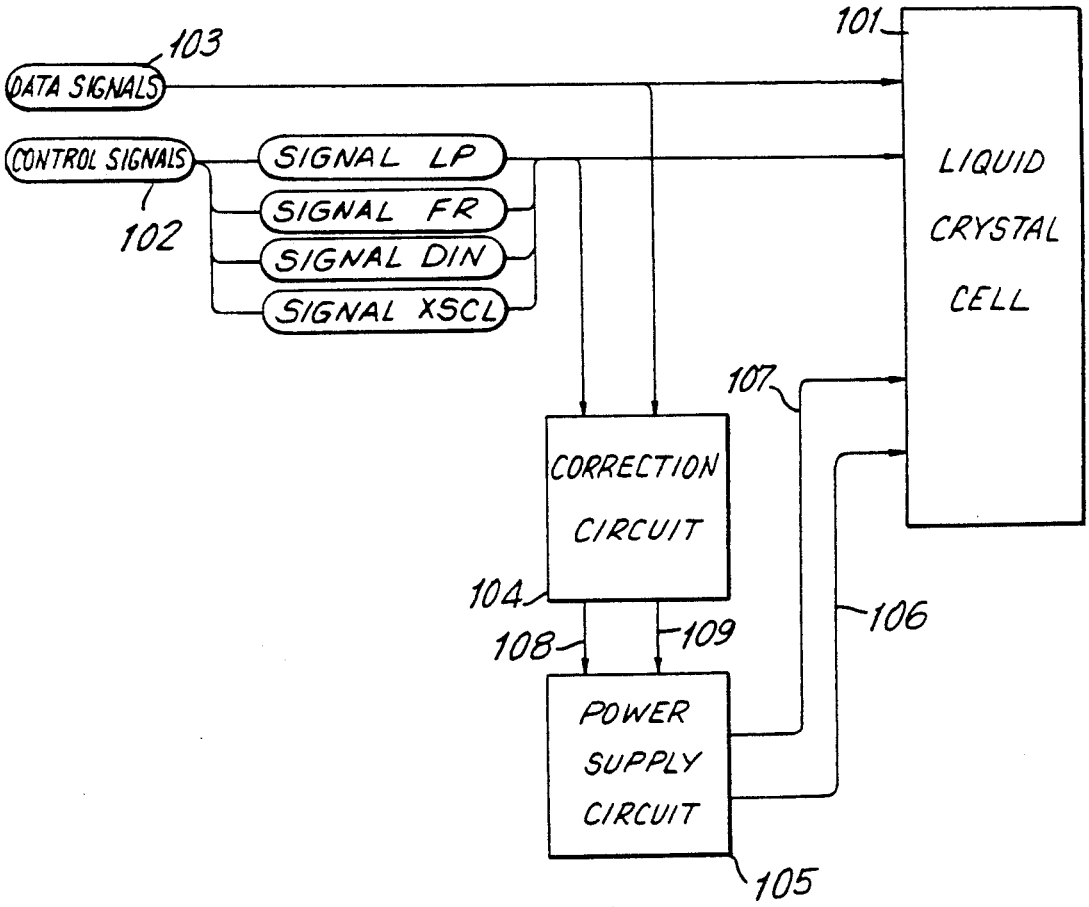
FIG. 1 is a block diagram of the circuitry for driving a liquid crystal display device in accordance with the invention.

FIG. 1 illustrates one specific embodiment of a liquid crystal display device 100 constructed and arranged in accordance with the invention for effecting these corrections. A liquid crystal device 100 includes a liquid crystal cell 101 which includes appropriate driving circuitry. A series of control signals 102 for controlling the operation of liquid crystal display device 100 includes a latch signal LP, a frame signal FR, a data-in signal DIN, an X-driver shift clock signal XSCL and a data signal 103. A waveform correcting signal generating circuit 104 receives the control signals and is coupled to a power supply circuit 105 which in turn is coupled to liquid crystal cell 101.

Correction circuit 104 calculates a numeric value F or I and transmits both a code signal 108 indicating a positive or negative of the numeric value F or I and a magnitude signal 109 indicating a magnitude of an absolute value of F or I to power supply circuit 105. Both code signal 108 and magnitude signal 109 are correction signals. Magnitude signal 109 is kept in an active state for a period corresponding to the absolute value of the numeric value F or I.

Power supply circuit 105 generates a scanning electrode driving power supply signal 106 which is the Y-power-supply and a signal electrode driving power supply signal 107 which is the X-power-supply signal. Specifically for liquid crystal cell 101 in accordance with code signal 108 and magnitude signal 109. Power supply circuit 105 acts to correct the voltage of Y-power-supply 106.

The fundamental operations of the embodiment shown in FIG. 1 are described as follows. Correction circuit 104 receives data signal 103 when a particular scanning electrode is selected and then counts the number $M_{ON}$ of lit elements on a subsequently selected scanning electrode. Then, correction circuit 104 determines the numeric values F and I, i.e., the sum of $M_{ON}$ and the number $N_{ON}$ of lit elements on the scanning electrode presently selected, and the difference therebetween. When the selection is shifted (polarity inversion), the resultant code and absolute value are outputted in the form of code signal 108 and magnitude signal 109. With polarity inversion, the numeric value I replaces the numeric value F and is likewise outputted. Concurrently with this step, the lit dot number $M_{ON}$ is taken in for storage for purposes of determining the number $N_{ON}$ of the lit dots on the scanning electrode selected. Power supply circuit 105 makes any corrections necessary for the Voltage Of Y-power-supply 106 on the basis of code signal 108 and magnitude signal 109.

The operations described above prevent uneven contrast which appears in the liquid crystal panel due to the first cause, namely, the difference in voltages applied to the element and outputted by the driving circuit. Based on the correcting method in this embodiment, a constant voltage is impressed in such a direction as to cancel the distortion created in the driving waveform applied to the liquid crystal display element during the period corresponding to the magnitude of the distortion. The direction of the constant voltage is determined by code signal 108, while the application period depends on magnitude signal 109.

Figure 2:
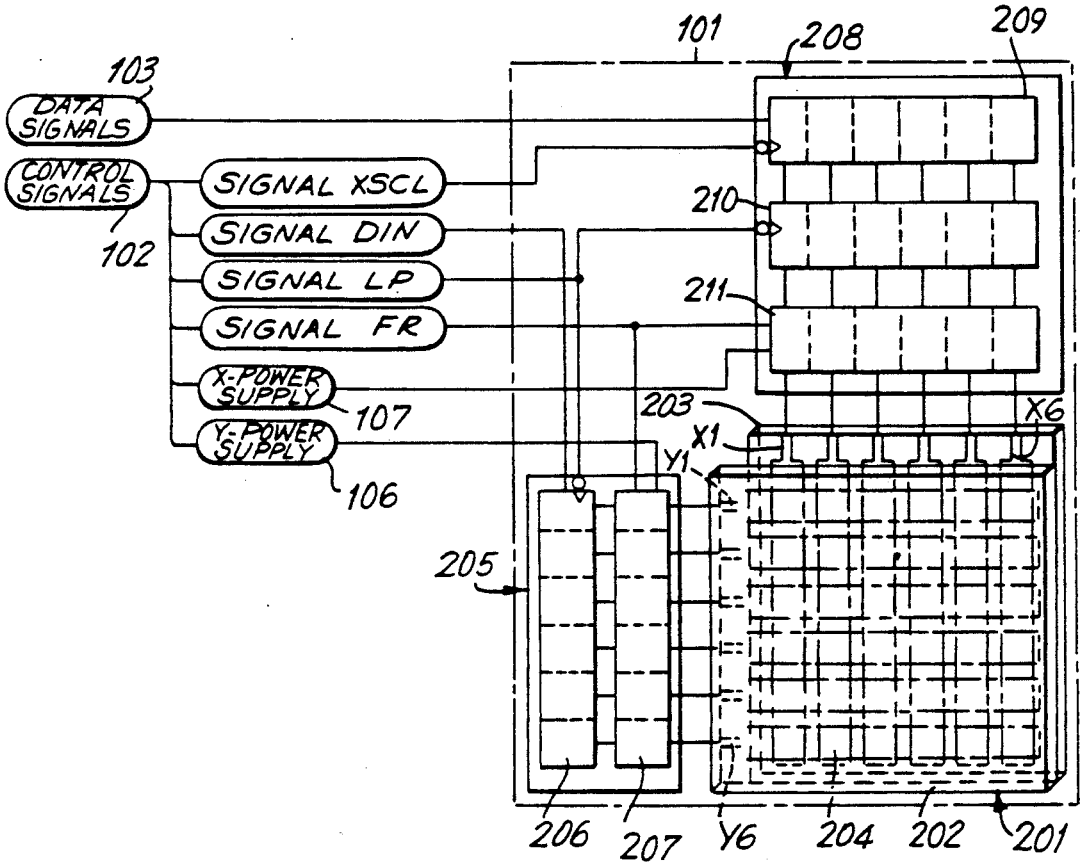
FIG. 2 is a block diagram illustrating a liquid crystal display device in accordance with a first embodiment of the invention.

The correction method is explained further with reference to FIGS. 2–5, which illustrate in detail the components of FIG. 1. FIG. 2 illustrates an example of a specific construction of liquid crystal display cell 101. A liquid crystal display panel 201 includes a pair of substrates 202 and 203 with a liquid crystal material in the space between the substrates. A plurality of scanning electrode lines Y1 to Y6 are arrayed sideways as rows on upper substrate 202 and a plurality of signal electrode lines X1 to X6 are vertically arrayed as columns on lower substrate 203. Display elements or pixels are formed at the intersections of scanning electrodes Y1 to Y6 and signal electrodes X1 to X6. Although this particular liquid crystal panel is a $6 \times 6$ matrix for simplicity of explanation, in reality the matrix may be significantly larger.

A scanning electrode driving circuit 205 includes a shift register circuit 206 coupled to a level shifter circuit 207. Outputs from level shifter circuit 207 are applied to scanning electrodes Y1 to Y6 liquid crystal panel 201.

A signal electrode driving circuit 208 includes a shift register circuit 209 coupled to a latch circuit 210, which in turn outputs to a level shifter circuit 211. Output signals from level shifter circuit 211 are applied to signal electrodes X1 to X6 in liquid crystal panel 201.

Figures 3A, 3B, 3C, 3D, 3E:
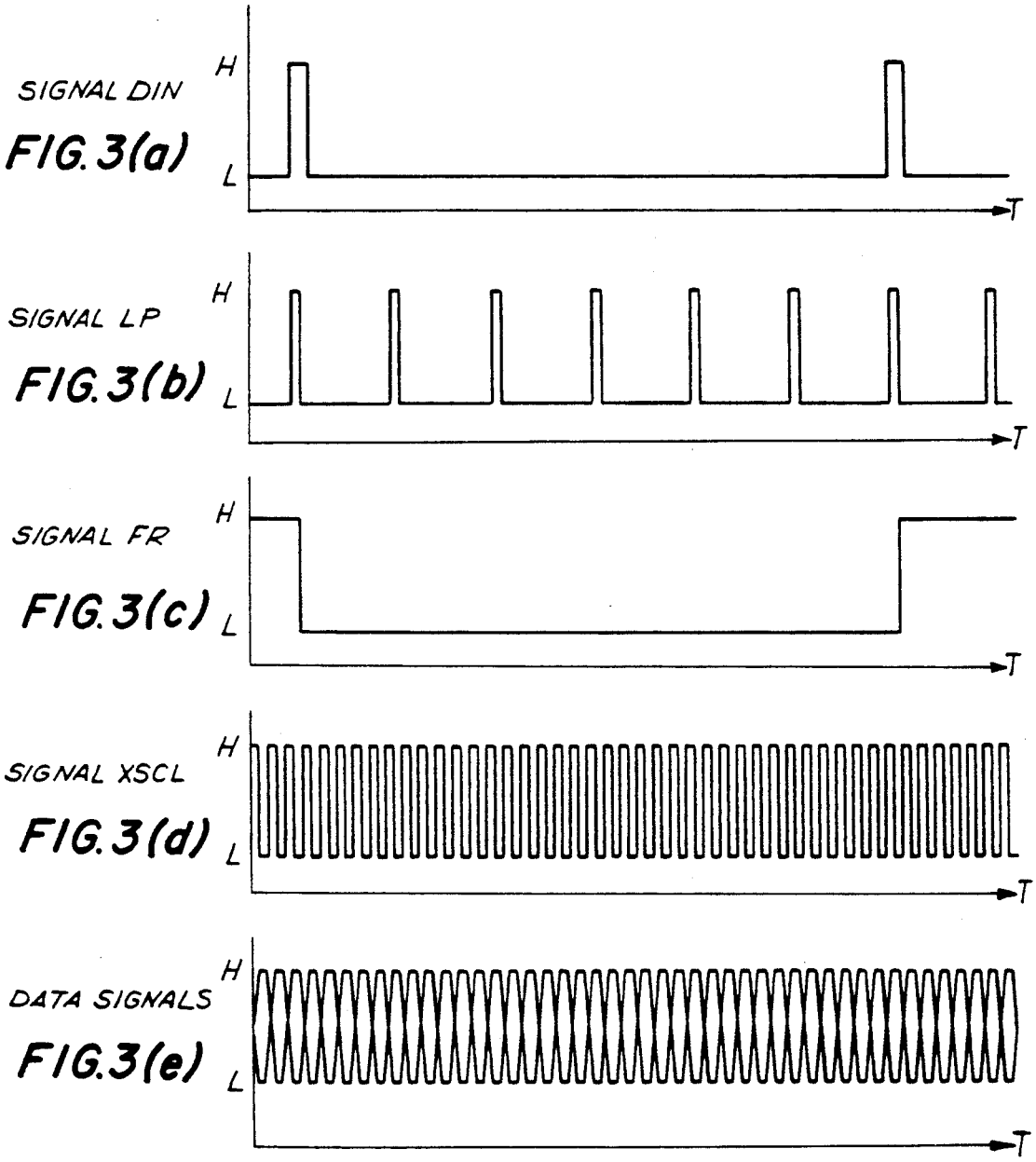
FIGS. 3(*a*)–3(*e*) are timing charts of the control signals and a data signal to be applied to the device of FIGS. 1 and 2.

FIGS. 3(*a*)–3(*d*) are timing charts showing signals D1N, LP, FR and XSCL, respectively, which are included within control signals 102. FIG. 2(*e*) shows a time chart of data signals 103 corresponding in time to the timing charts of FIGS. 3(*a*-3(*d*).

Signal DIN and Signal LP function as data and shift clocks, respectively for shift register circuit 206 of scanning electrode driving circuit 205. Upon a last transition of Signal LP, Signal DIN is input to shift register circuit 206 and then transferred. At this moment, Signal DIN, which is active when assuming an "H" level, is outputted once at an interval defined typically by the number of Signals LP which is equal to or greater than the number of scanning electrodes Y1 to Y6 in liquid crystal panel 201. Therefore, the data of an "H" level travels through the interior of shift register circuit 206, and in other cases the signal DIN assumes an "L" level. If Signal DIN is active, selective voltages are supplied to scanning electrodes Y1 to Y6 by level shifter circuit 207 according to the contents of shift register circuit 206. If Signal DIN is inactive, non-selective voltages are fed to scanning electrodes Y1 to Y6. Selective voltages and non-selective voltages are both supplied from Y-power-supply circuit 106.

Data signal 103 and Signal XSCL and Signal LP function as data and shift clocks of signal electrode driving circuit 208 and shift register circuit 209 and also as a latch clock of latch circuit 210. As shown in FIG. 3, data signal 103 is active when assuming an "H" level to exhibit a lit state. Data signal 103 acts as a signal for determining the state, lit or unlit, of a display element 204 on the next scanning electrode while a particular scanning electrode on liquid crystal panel 201 is being selected. During the selecting period of the particular scanning electrode, data signal 103 is inputted to shift register circuit 209 at a last transition of signal XSCL so that data signal 103 serves as a signal corresponding to the display element on the subsequently selected scanning electrode. After data signal 103 is input on the basis of the Signal XSCL, the contents of shift register circuit 209 is in turn input to latch circuit 210 at a last transition of Signal LP. Subsequently, in conformity with the contents therein, lighting voltages are fed to the signal electrodes X1 to X6 via shift register circuit 211 when data signal 103 is in the active state. Likewise, when data signal 103 is in the inactive state, non-lighting voltages are applied to signal electrodes X1 to X6. The light and non-lighting voltages are both applied from X-power-supply 107.

Frame Signal FR is applied to X-driving circuit 205 and Y-driving circuit 208 to AC-drive liquid crystal panel 201. Signal FR changes in synchronization with the last transition of Signal LP, thereby changing the selection of potentials of the driving voltages. More specifically, the driving voltages include two groups of voltages, i.e., one group is selective/non-selective voltages, and the other is lighting/non-lighting voltages. The driving voltages are changed by Frame Signals FR.

The construction of liquid crystal display cell 101 and the driving method thereof are illustrated in order to explain the invention, but the above-described construction and method are not intended to be limiting.

Figure 4:
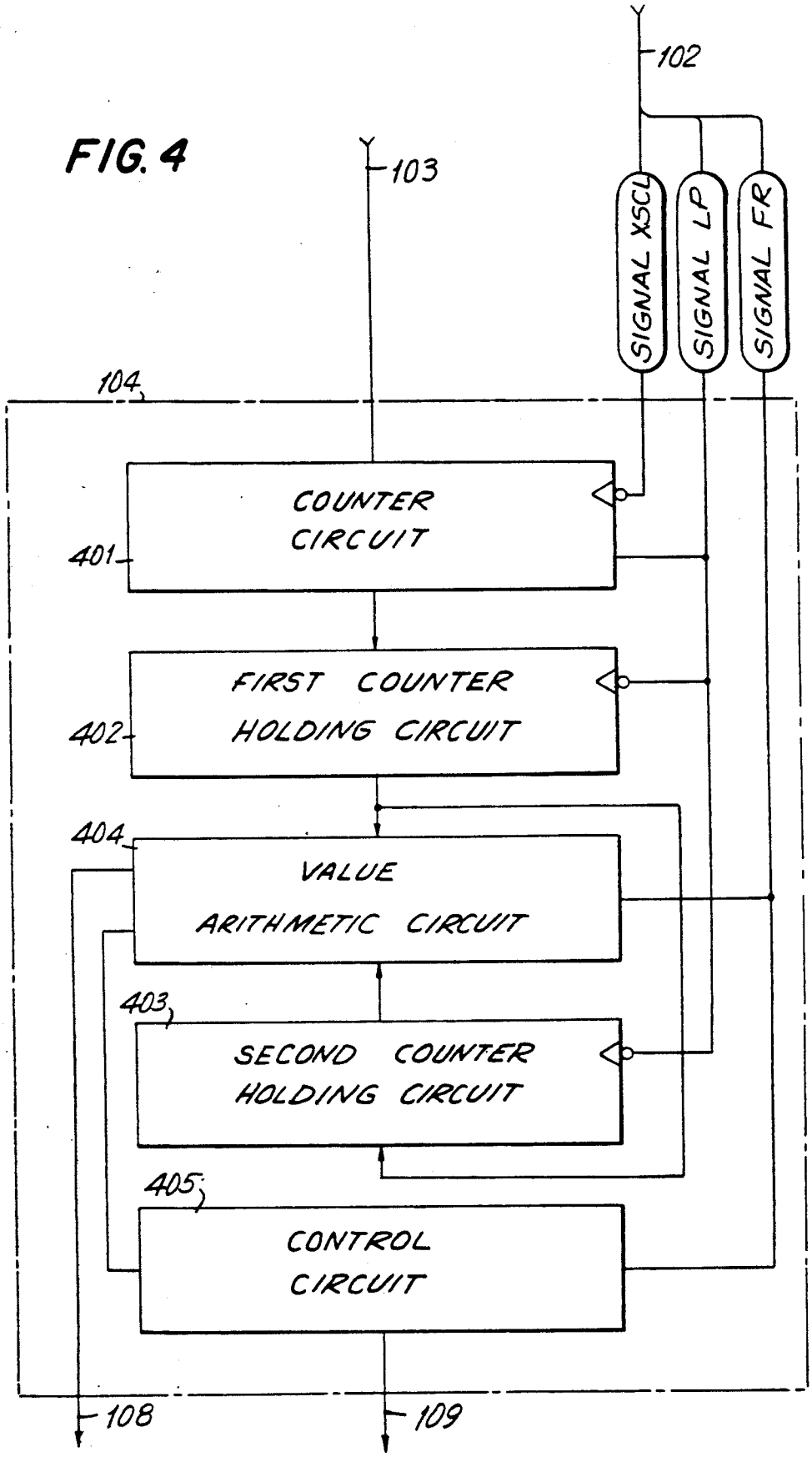
FIG. 4 is a block diagram showing one example of a correction circuit for use in the device of FIGS. 1 and 2.

FIG. 4 is a block diagram showing an example of specific circuitry of correction circuit 104 depicted in FIG. 1, including a counter circuit 401 coupled to a first count holding circuit 402, a second count holding circuit 403, a value arithmetic circuit 404, and a pulse width control circuit 405.

Counter circuit 401 counts the number of lit elements among the display matrix on a (n+1)th scanning electrode during the selecting process of the (n)th scanning electrode in liquid crystal panel 201 of FIG. 2. Counter circuit 401 counts the number of lit elements on the (n+1)th scanning electrode by effecting addition only when data signal 103 is in an active state at a last transition of Signal XSCL during a period ranging from the last transition of Signal LP among control signals 102 to the next last transition thereof. At the last transition of Signal LP a count value is outputted to first count holding circuit 402, and at the same time a count value of counter circuit 401 is reset to 0. After this step, counting resumes. These steps are repeated sequentially. Counting may be performed as well on more than a single element basis depending on the size of the matrix. For example, the counting may be set to ±16 elements if the number of signal electrodes X1 to X6 is approximately 640.

Next, at the last transition of Signal LP, first count holding circuit 402 sequentially inputs a count value just before the count value of counter circuit 401 becomes 0. At the last transition of Signal LP, second count holding circuit 403 sequentially inputs a count value from first count holding circuit 402 just before first count holding circuit 402 inputs the next count value from counter circuit 401. Hence, when first count holding circuit 402 inputs the lit dot number $M_{ON}$ of display elements on the (n+1)th scanning electrode, second count holding circuit 403 is inputting the lit dot number $N_{ON}$ of the display dots on the (n)th scanning electrode. The numeric values $M_{ON}$ and $N_{ON}$ are respectively outputted to value arithmetic circuit 404.

Subsequently, value arithmetic circuit 404 computes the sum F and difference I between the numeric values $M_{ON}$ and $N_{ON}$ generated by first and second count holding circuits 402 and 403, the calculations being such that $F=N_{ON}+M_{ON}$ and $I=N_{ON}-M_{ON}$. If Signal FR does not vary (because of no polarity inversion), a code of the value I is outputted from value arithmetic circuit 404 circuit 404 in the form of code signal 108. Simultaneously, an absolute value of I is outputted to pulse width control circuit 405. If Signal FR varies (because of polarity inversion), the value F is likewise outputted. The value F is, depending on the circuit, outputted as code signal 109.

Pulse width control circuit 405 outputs an active signal or magnitude signal 109 for time corresponding to the absolute value of F or I inputted from value arithmetic circuit 404 in synchronization with the last transition of Signal LP among control signals 102. Incidentally, a relationship between the value F, the value I and a width W of magnitude signal 109 may be obtained, by experimentation. Width W may differ depending on whether the value of I is positive or negative. In this embodiment width W is not dependent on whether the value I is positive or negative. The relationship, namely $W=a_1 \cdot I$ and $W=a_1 \cdot F+a_0$ are true.

The operation and function of correction circuit 104 has been described above. Specific circuitry of the individual components 401 to 405 of correction circuit can be arranged in the manner discussed above, and hence the description is omitted herein.

Figure 5:
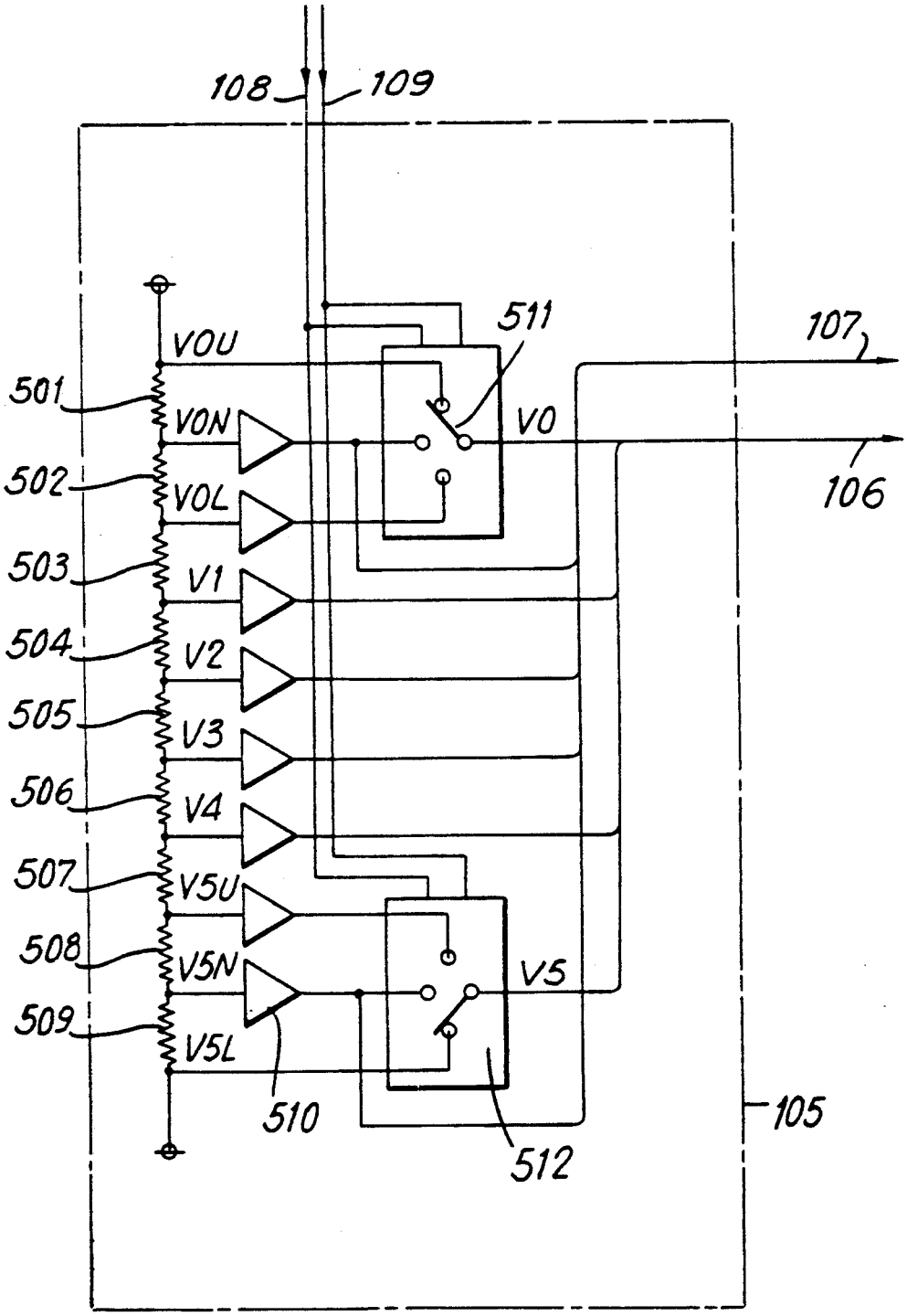
FIG. 5 is a schematic diagram of a voltage power supply circuit for use in the device of FIGS. 1 and 2.

FIG. 5 illustrates specific circuitry of voltage power supply circuit 105 shown in FIG. 1. Resistors 501 to 509 are sequentially connected in series, both ends of which are supplied with a voltage V0U and a voltage V5L. Voltages generated at respective ends of each resistor 501 to 509 are indicated by V0U, VON, VOL, V1, V2, V3, V4, V5U, V5N and V5L, respectively. The voltages are as follows:

$$
\begin{aligned}
& VON - V1 \\
= \; & V1 - V2 \\
= \; & V3 - V4 \\
= \; & V4 - V5N \\
= \; & (V2 - V3)/(n - 4)
\end{aligned}
$$

where n is the constant.

Or, $$
\begin{aligned}
& (VOU - VON)/(VON - V1) \\
= \; & (V5N - V5L)/(V4 - V5N) \\
& (VON - VOL)/(VON - V1) \\
= \; & (V5U - V5N)/(V4 - V5N)
\end{aligned}
$$

Resistance values of individual resistors 501 to 507 are set to establish these relationships.

A voltage stabilizing circuit 510 stabilizes the split voltages VON, VOL, V1, V2, V3, V4, V5U and V5N across resistors 501 through 509. In circuit 510, a voltage having the same level as an input voltage is outputted to cause a low impedance. In this embodiment, voltage stabilizing circuit 510 includes a voltage follower circuit based on an arithmetic amplifier circuit.

Switches 511 and 512 are changed in response to code signal 108 and magnitude signal 109 of FIG. 1. When magnitude signal 109 and code signal 108 have negative values for I and F, switches 511 and 512 of FIG. 5 change to voltages VOU and V5L while magnitude signal 109 remains active. When magnitude signal 109 and code signal 108 have a positive value for I, the switches change to voltages VOL and V5U while magnitude signal 109 is kept active. In either case, when magnitude signal 109 becomes inactive, the switches change to voltages VON and V5N. Voltages outputted by switches 511 and 512 are V0 and V5.

Voltages VON and V2 are defined as one group of lighting and non-lighting voltages, while voltages V5N and V3 are the other group of lighting and non-lighting voltages. The two groups of lighting and non-lighting voltages combine to form X-power-supply signal 107. Similarly, voltages V5 and V1 are defined as one group of selective and non-selective voltages, while voltages V0 and V4 are the other group of selective and non-selective voltages. The two groups of selective and non-selective voltages combine to form Y-power-supply signal 106. X-power-supply signal 107 and Y-power-supply signal 106 are applied to liquid crystal display cell 101 of FIG. 1.

Figure 6:
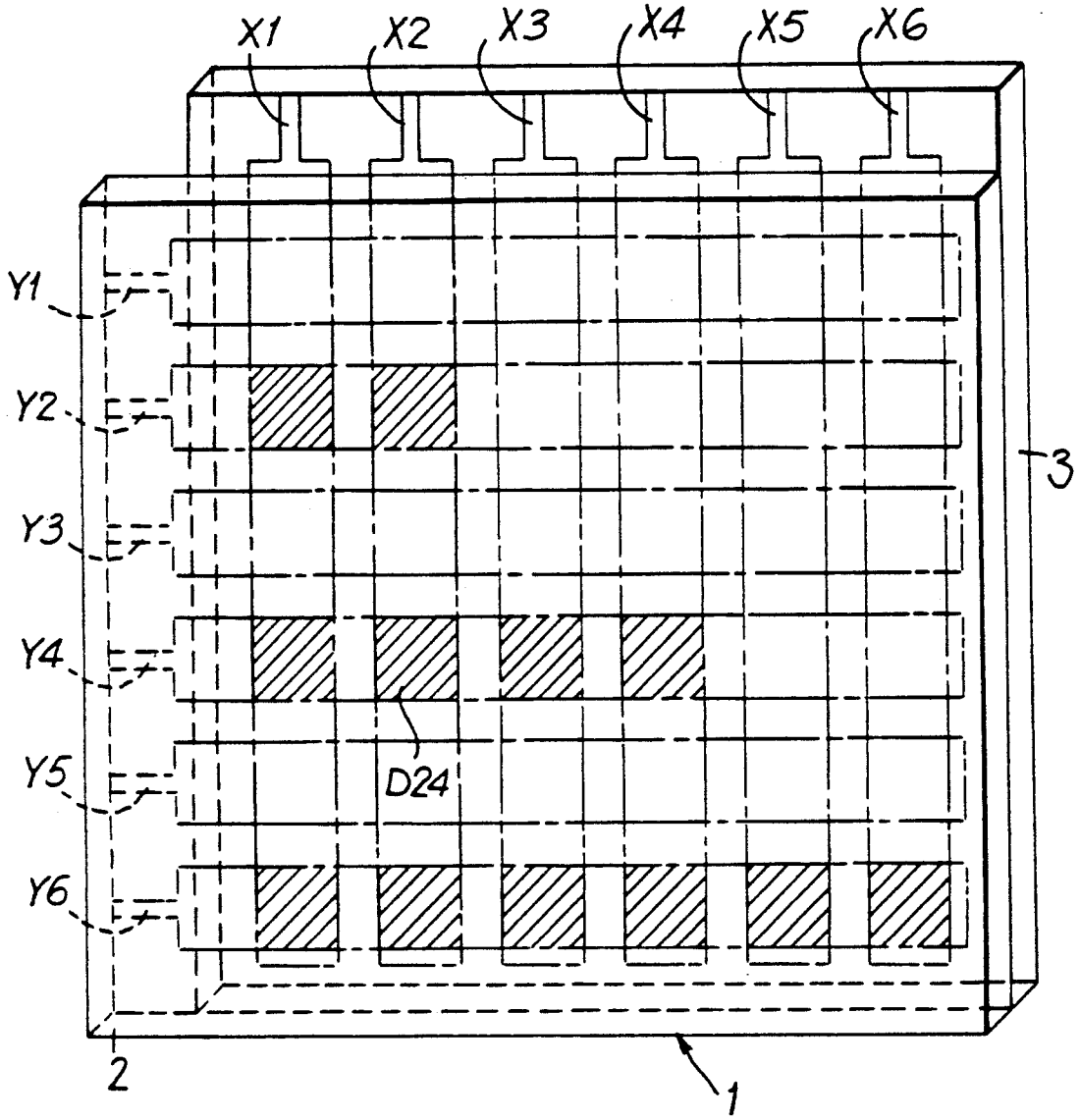
FIG. 6 is a diagram illustrating a display matrix on the liquid crystal panel of the device of FIGS. 1 and 2.
Figure 7A:
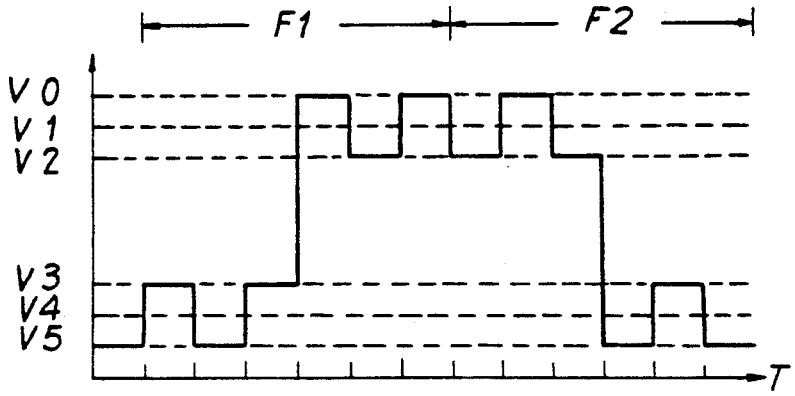
FIGS. 7(*a*)–7(*c*) show the voltage waveforms in accordance with a first embodiment of the invention.
Figure 7B:
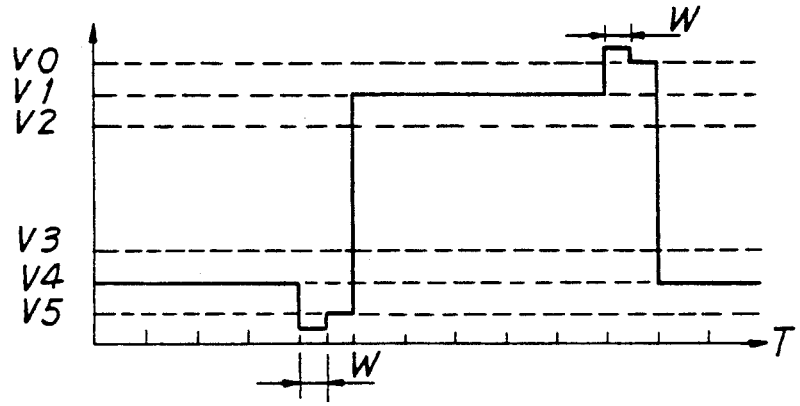
Figure 7C:
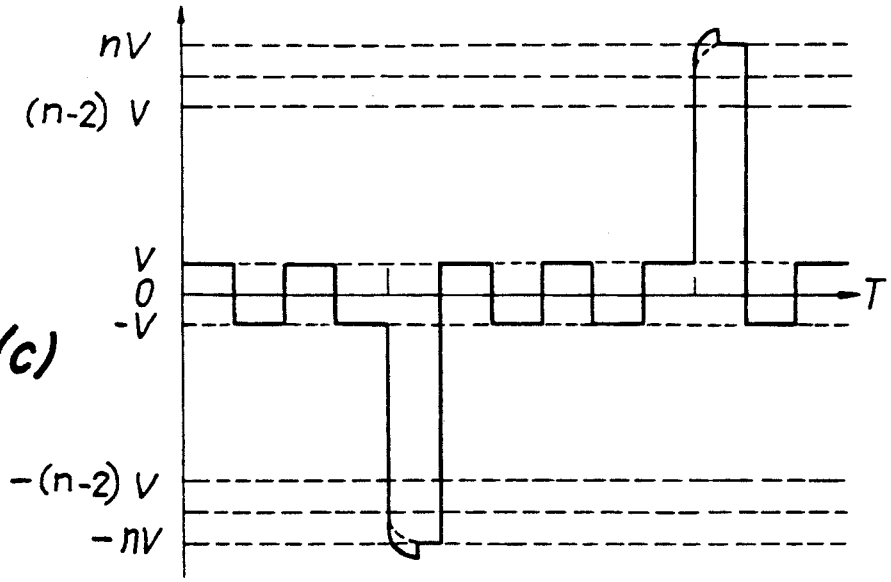

The following examples of the operation are based on the configuration described above. FIG. 6 illustrates liquid crystal panel 201 (shown in FIG. 2) in which the display elements shown with diagonal lines are in the lit state. FIGS. 7(*a*) through 7(*c*) are driving voltage waveforms in accordance with this embodiment of the invention when effecting the display shown in FIG. 6. The polarity is inverted between scanning electrodes Y3 and Y4. The number of polarity inversions and the positions thereof are not limited and may be selected arbitrarily.

FIG. 7(*a*) shows a waveform of the signal voltage applied to signal electrode X2. FIG. 7(*b*) illustrates a waveform of scanning voltage impressed on scanning electrode Y4. The polarity inversion is effected at scanning electrode Y4, and hence the selective voltage becomes VOU or V5L for only a time period W obtained by adding the time corresponding to the value F to a designated span of time. The correction voltage is added to the selective voltage of V0 or V5 resulting in the selective voltage of V0U or V5L, respectively. This correction voltage is applied for a time period W immediately after a change in the voltage level of the signal voltage waveform shown in FIG. 7(*a*) and is required to compensate for uneven display contrast arising from crosstalk.

FIG. 7(*c*) illustrates a waveform (indicated by a solid line) of voltage actually applied to display element D24 at the intersection of signal electrode X2 and scanning electrode Y4. The voltage included by the broken line is a rounding generated which corresponds to the sum of the designated value and the value F created when the polarity is inverted (i.e., when selective voltage = V0U or V5L during time period W).

As illustrated in FIGS. 7(*a*) 7(*b*) and 7(*c*), correction circuit 104 of FIG. 1 outputs magnitude signal 109 during polarity inversion which remains active during the period obtained by adding the designated span of time to the time equivalent to the value F. Code signal 108 is negative. While magnitude signal 109 is kept active, power supply circuit 105 outputs V0U and V5L as selective voltages (voltages V0 and V5) combined to constitute Y-power-supply signal 107, and further outputs V0N and V5N when magnitude signal 109 becomes inactive.

For this reason, the rounding indicated by the broken line in FIG. 7(*c*) is, as shown by the solid line, substantially corrected, because the selective voltages are changed into voltages V0U and V5L for only the time W shown in FIG. 7(*b*). Accordingly, the effective voltage is corrected, thereby obviating any unevenness in contrasting during polarity inversions due to the first cause.

During selective shifting other than the polarity inversion, the operations are substantially the same, except that magnitude signal 109 and code signal 108 of FIG. 1 depend on the value I instead of the value F. Specifically, magnitude signal 109 continues to be active during a period corresponding to the value I. During the active period, when code signal 108 is positive, voltages V0L and V5U are outputted as the voltages V0 and V5. During the inactive period, voltages V0N and V5N are outputted as the voltages V0 and V5.

On the basis of these operations, as in the case of polarity inversion, distortion in the waveform of effective voltage applied to the display element is corrected and unevenness in contrast is eliminated.

EMBODIMENT 2

If the correction which uses the value I in the case of no polarity inversion is omitted from Embodiment 1, almost the same results can be acquired with this simplified circuitry.

EMBODIMENT 3

The correction which uses the value F at the time of polarity inversion is omitted from Embodiment 2, and instead the correction is performed invariably for a given time. Even so, almost the same effects can be obtained with this simplified circuitry.

EMBODIMENT 4

As in Embodiments 1 to 3, the correction is carried out by changing the selective voltages. However, other non-selective voltages, lighting voltages and non-lighting voltages may be varied.

EMBODIMENT 5

As in Embodiments 1 to 4, the correction is effected while changing the regular voltages for only a period corresponding to the values I and F. However, the voltages corresponding to the values I and F may be applied for a given time, or alternatively the voltages may be impressed during a period corresponding to the values I and F. Additionally, the waveforms of voltages applied to perform the correction may assume not only a rectangular configuration but also triangular and trapezoidal shapes, as well as other configurations expressed by exponential functions.

EMBODIMENT 6

The unevenness in display attributable to the display contents occurs because a voltage on the signal electrode, which intersects a scanning electrode (hereinafter referred to as scanning electrode YS) which changes from a selective to non-selective voltage during polarity inversion, is dragged towards the selective voltage after the polarity inversion occurs. The problem is compounded with the unevenness which corresponds to the number of display elements on the scanning electrodes selected before and after polarity inversion. Thus, during operation of the liquid crystal display device, the non-selective voltage on scanning electrode YS approaches the selective voltage by an amount with which the voltage on the signal electrode is dragged towards the selective voltage. The non-selective voltage on scanning electrode YS also superposes a voltage corresponding to the sum F calculated for the non-selective voltage applied to scanning electrode YS, such that an effective voltage of the display elements on scanning electrode YS equals the display elements on other scanning electrodes. The correcting method described above is capable of obviating the unevenness on the display due to this cause.

Figure 8:
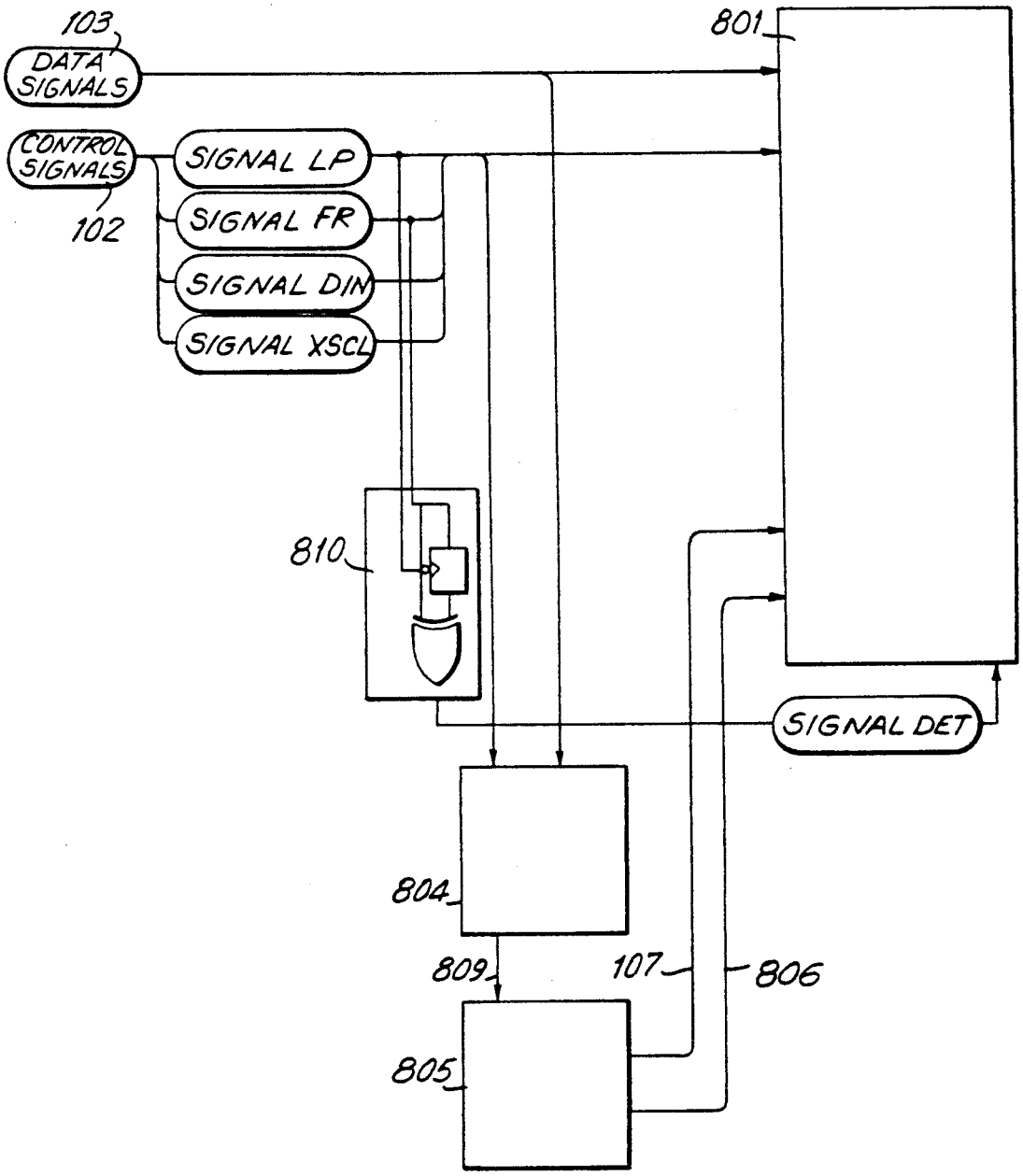
FIG. 8 is a block diagram of the circuitry of a liquid crystal display device in accordance with another of the invention.

FIG. 8 shows a liquid crystal display device in accordance with another embodiment for performing this correction. A liquid crystal cell 801 includes a liquid crystal panel and a driving circuit. Control signal 102 and data signal 103 are the same as those shown in FIG. 1. A waveform correcting signal generating circuit 804 calculates the sum of lit elements on the scanning electrodes selected before and after shifting the selection. Correction circuit 804 generates a magnitude signal 809 which remains active for a time corresponding to the results of the calculation. Voltage power supply circuit 805 creates both an X-power-supply signal 107 including two groups of lighting and non-lighting voltages, and a Y-power-supply signal 806 including two groups of selective, non-selective and correction non-selective voltages. The correction non-selective voltage varies in accordance with magnitude signal 809. A polarity inversion detecting circuit 810 includes a flip-flop circuit coupled to an exclusive OR circuit. Inversion detecting circuit 810 outputs a Signal DET assuming an "H" level until Signal LP rises after being synchronized with Signal FR. In other words, circuit 810 detects when Signal FR varies.

Figure 9:
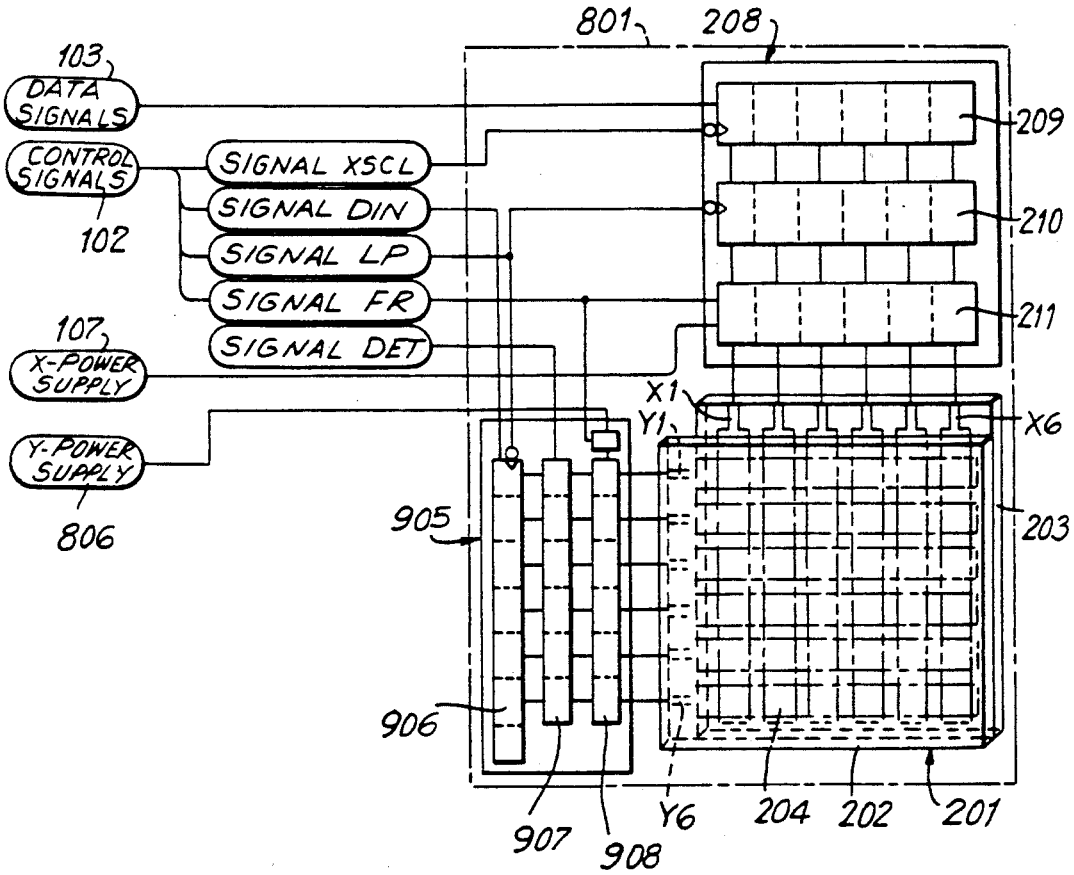
FIG. 9 is a block diagram showing the liquid crystal display device of FIG. 8.

The operation of the components in this embodiment will now be explained. FIG. 9 shows the configuration of liquid crystal display cell 801. The configuration and operation of liquid crystal panel 201 are the same as previously described, as is signal electrode driving circuit 208. Therefore the components thereof are identified with like reference numerals and the descriptions omitted. As shown in FIG. 9, a scanning electrode driving circuit 905 includes of at least one shift register 906 having a greater number of bits than the number of scanning electrodes Y1 to Y6 coupled to a multiplexer circuit 907 which is coupled to switch circuits 908 and 909.

Figure 10:
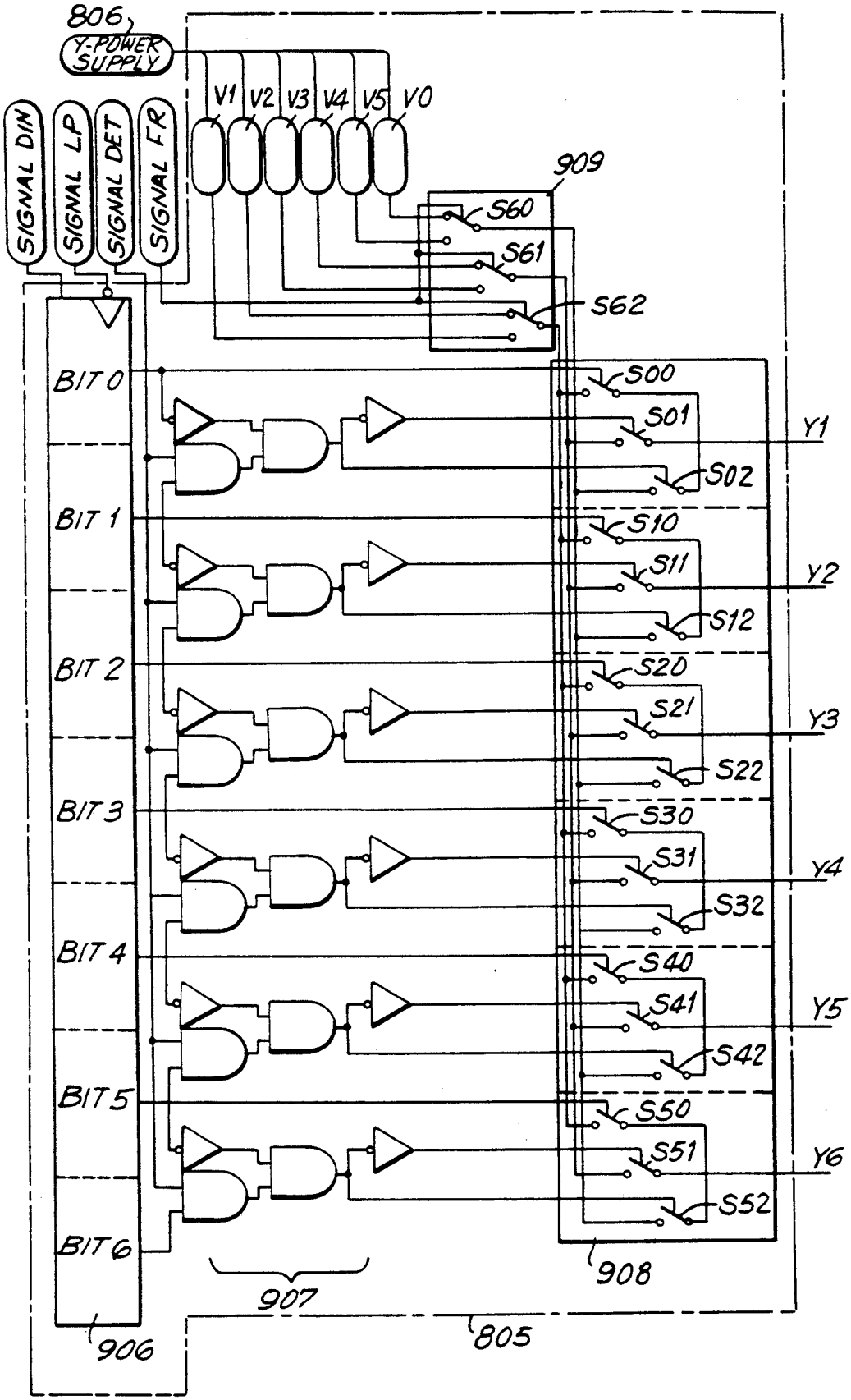
FIG. 10 is a schematic diagram showing the scanning electrode driving circuit of FIG. 8.

The circuitry of scanning electrode driving circuit 905 will fully be described with reference to FIG. 10. Shift register 906 is a seven-bit register which shifts the "H" level sequentially from BIT0 to BIT1 and further to BIT2 at each last transition of Signal LP after receiving Signal DIN at the transition of Signal LP. Multiplexer circuit 907 thus outputs a signal for turning ON a switch Sn0 (n=0 to 5) of switch circuit 908 when the output of BITn (n=0 to 5) of shift register 906 is at the "H" level. Multiplexer circuit 907 also outputs a signal for turning ON a switch Sn1 when the output of BITn is at the "L" level and Signal DET assumes the "L" level. When the output of BITn is at the "L" level, Signal DET assumes the "H" level and an output of BIT(n+1) is at "L". Multiplexer circuit 907 generates a signal for turning ON switch Sn2 when the output of BITn is at the "L" level, the output of BIT(n+1) is at "H" and Signal DET assumes the "H" level. At this time, multiplexer circuit 907 generates signals for turning OFF other switches Sn0 to Sn2 when outputting a signal for turning ON any one of the switches Sn0 to Sn2. Switch circuit 908 has six groups of switches, each group including three switches Sn0, Sn1 and Sn2 (n=0 to 5). These switches take one voltage among the selective, non-selective and correction non-selective voltages in accordance with outputs of multiplexer circuit 907, and output these voltages to scanning electrodes Y1 to Y6 in liquid crystal panel 201. Switch circuit 909 includes switches S60, S61 and S62 and changes over one group of voltages from two groups of selective, non-selective and correction non-selective voltages of Y-power-supply 806 in response to Signal FR.

The operation is as follows. One group of voltages is selected from two groups of selective, non-selective and correction non-selective voltages by use of the Signal FR. Characteristic of the switches of switch circuit 908, switch Sn0 is turned ON, and the selective voltages are outputted when BITn is at the "H" level, i.e., in a selective state. Then, switch Snl is turned ON, and the selective voltages are outputted when an output of BITn is at the "L" level and the signal DET assumes the "L" level, such as in the case of the non-selective state with no polarity inversion. When the output of BITn is at the "L" level, Signal DET assumes the "H" level and an output of BIT(n+1) is at the "L", such as in the case of the non-selective state, effecting the polarity inversion and no selective state being present just before inverting the polarity. Switch Sn2 is turned ON, and the correction non-selective voltages are outputted when the output of BITn is at the "L" level. Signal DET assumes the "H" level and the output of BIT(n +1) is at the "H" level, such as in the case of the non-selective state, effecting the polarity inversion and the selective state being present just before performing the polarity inversion.

Scanning electrode driving circuit 905 functions in the manner discussed above. However, the construction of switch circuits 908 and 909 and multiplexer circuit 907 are not limited but may take any form such that similar voltages can be outputted.

Figure 11:
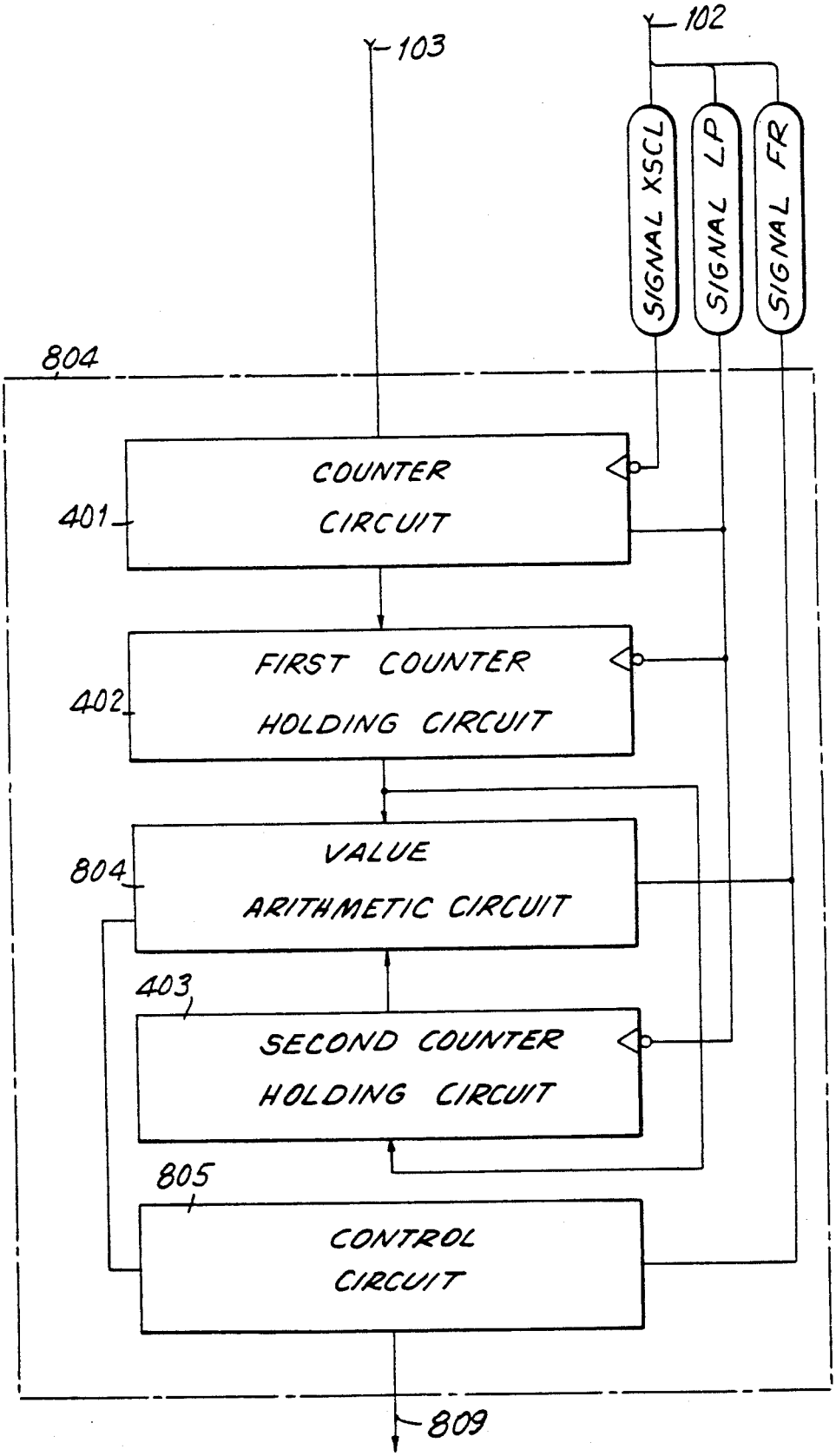
FIG. 11 is a block diagram of a correction circuit for use in the device of FIG. 8.

FIG. 11 illustrates the circuitry of correction circuit 804 in FIG. 8 and includes counter circuit 401, first count holding circuit 402 and second count holding circuit 403 as in FIG. 4. Since the components identified by like numerals have the same functions, the descriptions are omitted. An arithmetic correction circuit 804 outputs to the pulse width control circuit 805 a sum of values $N_{ON}$ and $M_{ON}$ given from first and second count holding circuits 402 and 403, the calculation being $F=N_{ON}+M_{ON}$. A pulse width control circuit 805 in synchronization with the last transition of Signal LP, in turn outputs an active signal, for example, a magnitude signal 809 which remains active only during the period obtained by adding a designated time to a time corresponding to the numeric value F input thereto. Correction circuit 804 has the circuitry and functions previously described.

Figure 12:
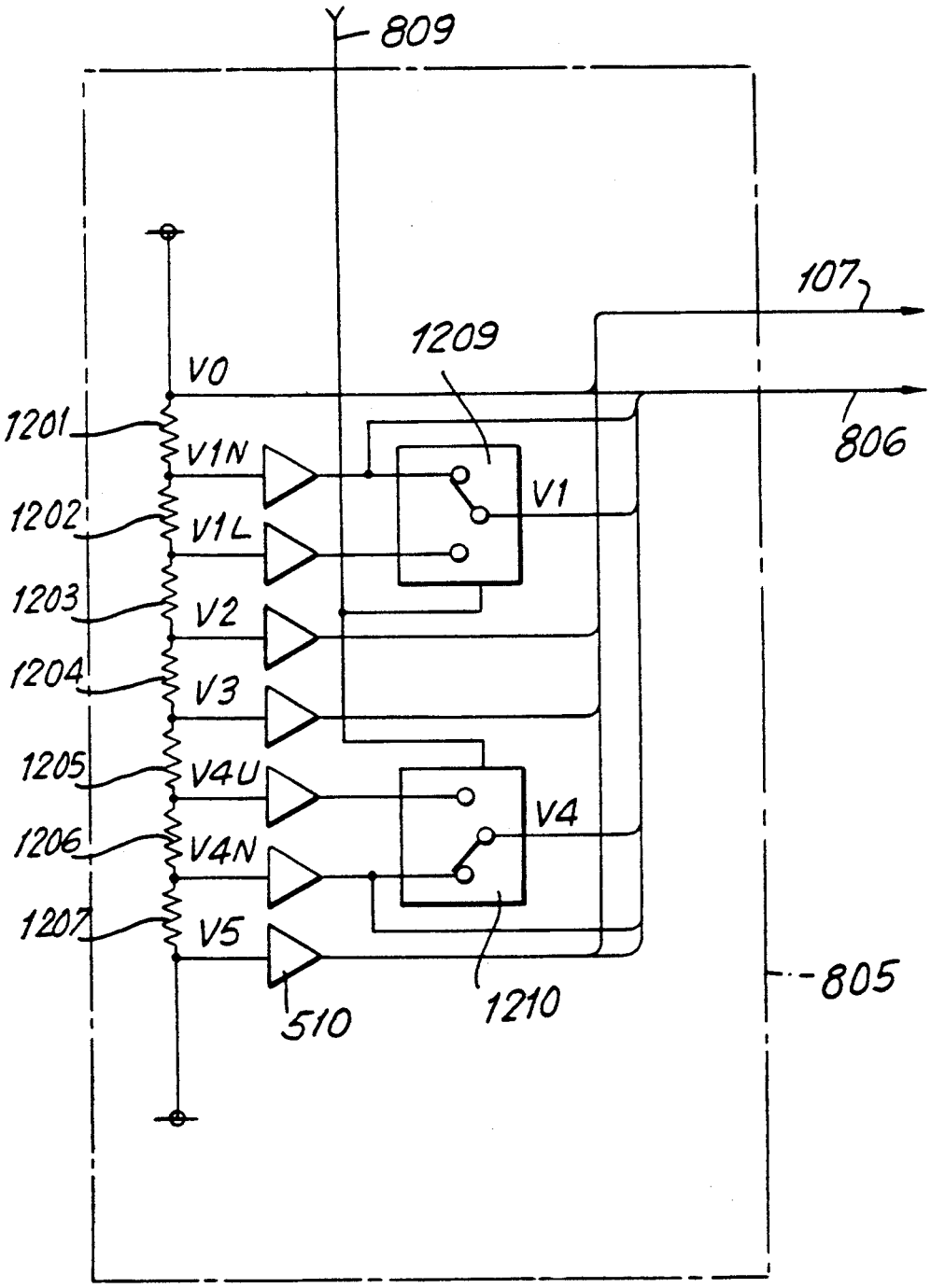
FIG. 12 is a schematic diagram of a voltage power supply circuit for use in the device of FIG. 8.

FIG. 12 illustrates the specific circuitry of an example of voltage power supply circuit 805 of FIG. 8. Resistors 1201 to 1207 are sequentially connected in series, both ends of which are supplied with voltages V0 and V5. The voltages generated at the respective ends of resistors 1201 to 1207 are, as shown in the Figure, V0, V1N, V1L, V2, V3, V4U, V4N and V5.

$$\begin{aligned} & V0 - V1N \\ = \; & V1N - V2 \\ = \; & V3 - V4N \\ = \; & V4N - V5 \\ = \; & (V2 - V3)/(n - 4) \end{aligned}$$

where n is the constant. Likewise, $$\begin{aligned} & V1N - V1L \\ = \; & V4U - V4N \end{aligned}$$

Resistance values of individual resistors 1201 to 1207 are set to establish the foregoing relationships. Voltage stabilizing circuit 510 is constructed in the same manner and has the same function as circuit 510 in FIG. 5.

Switches 1209 and 1210 output voltages V1L and V4U during an active period of magnitude signal 809 of FIG. 8. During an inactive period, switches 1209 and 1210 output voltages V1N and V4N. The output voltages of switches 1209 and 1210 are set anew at voltages V1' and V4'.

Voltage power supply circuit 805 outputs X-power-supply signal 107 in which voltages V0 and V2 are defined as one group of lighting and non-lighting voltages, while voltages V5 and V3 are defined as the other group of lighting and non-lighting voltages. Circuit 805 also outputs Y-power-supply signal 806 in which voltages V5, V1n and V1 are one group of selective, non-selective and correction non-selective voltages, while voltages V0, V4N and V4, are the other group of selective, non-selective and correction non-selective voltages.

Figure 13:
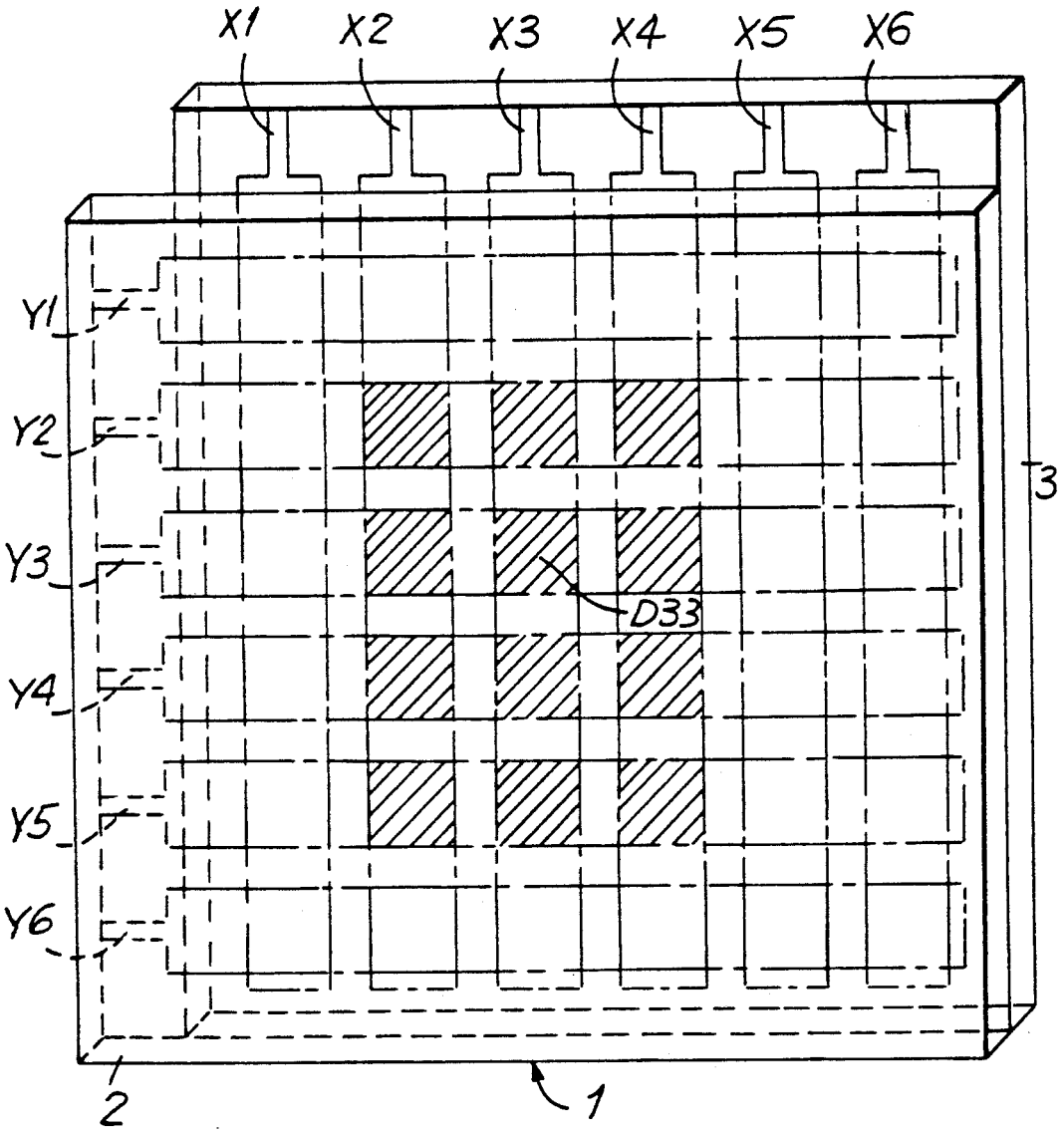
FIGS. 13, 15, 17 and 23 are diagrams showing various display contents of the liquid crystal panel of FIG. 6.

Operation of voltage power supply circuit 805 thus constructed will be explained by way of a specific example. FIG. 13 shows liquid crystal display panel 201 of FIG. 9, wherein the shaded display elements are in a lit state.

Figure 14A:
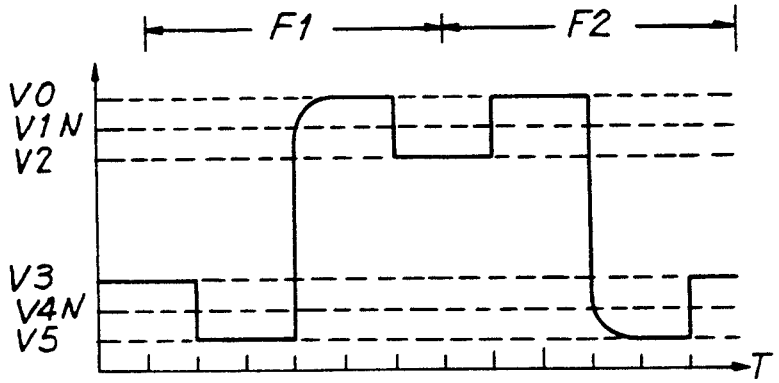
FIGS. 14(*a*)–14(*c*) and 16(*a*)–16(*c*) are voltage waveforms applied to the panel of FIG. 6.
Figure 14B:
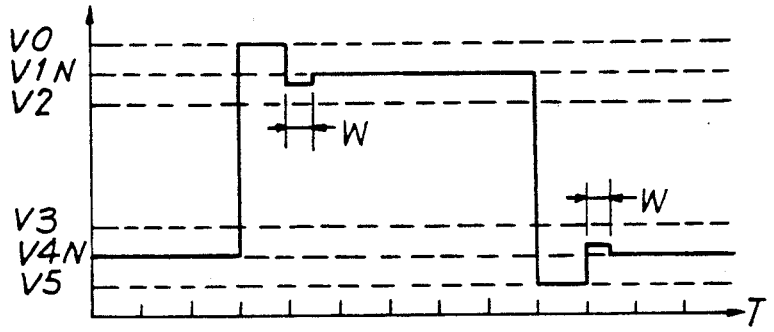
Figure 14C:
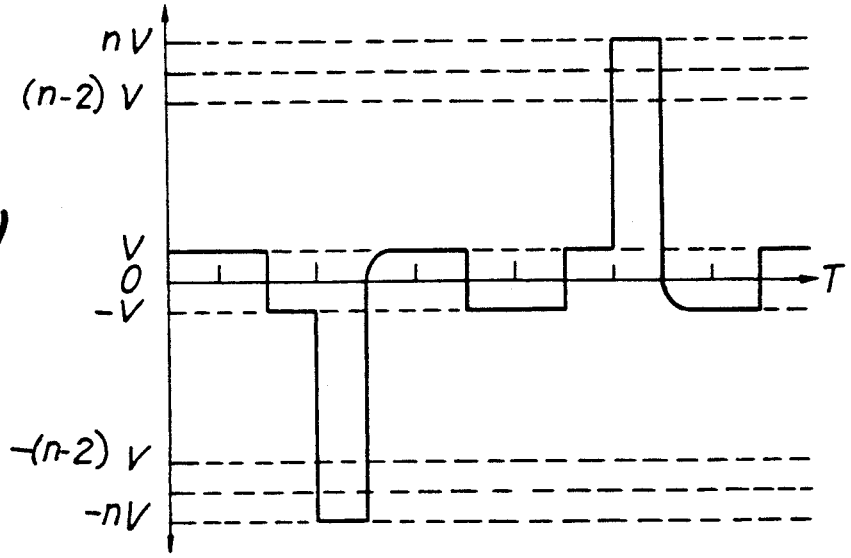
Figure 15:
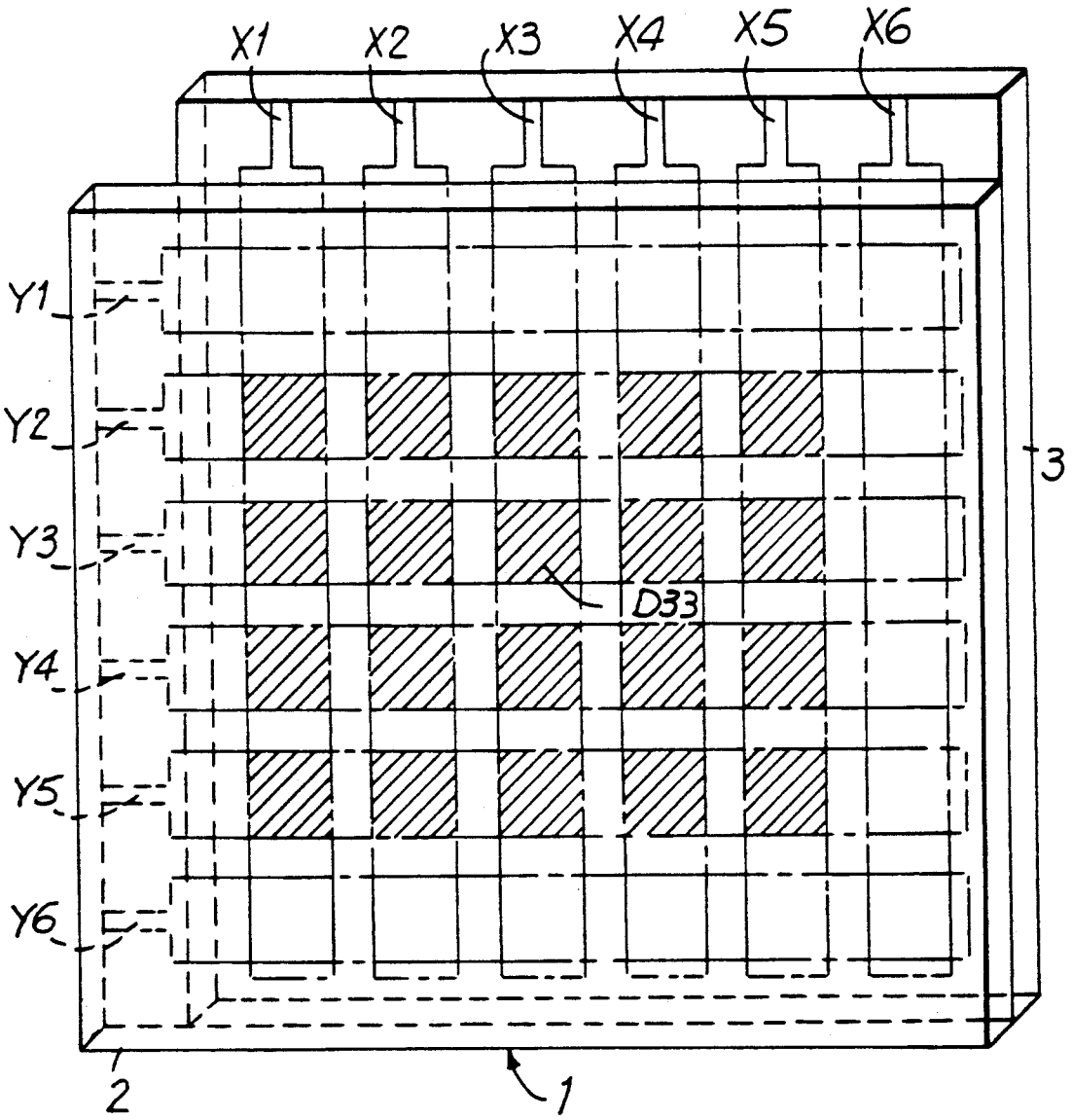
Figure 16A:
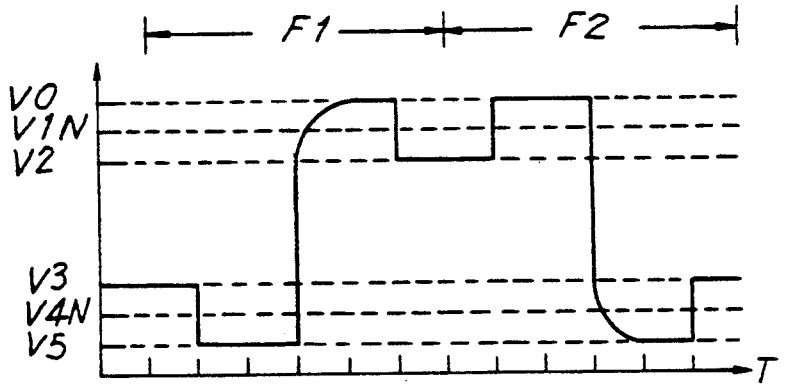
Figure 16B:
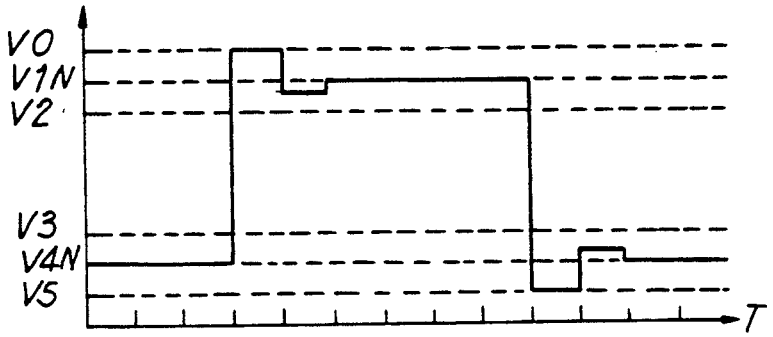
Figure 16C:
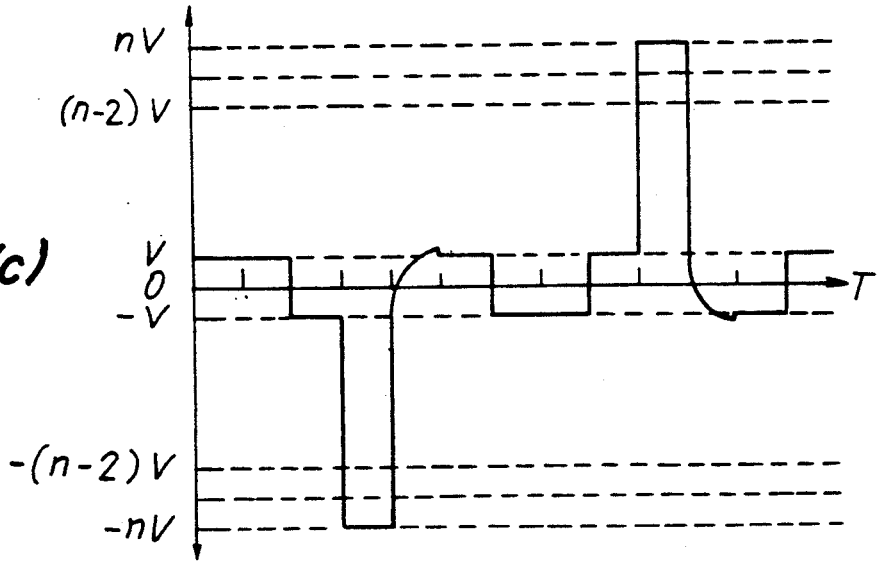
Figure 17:
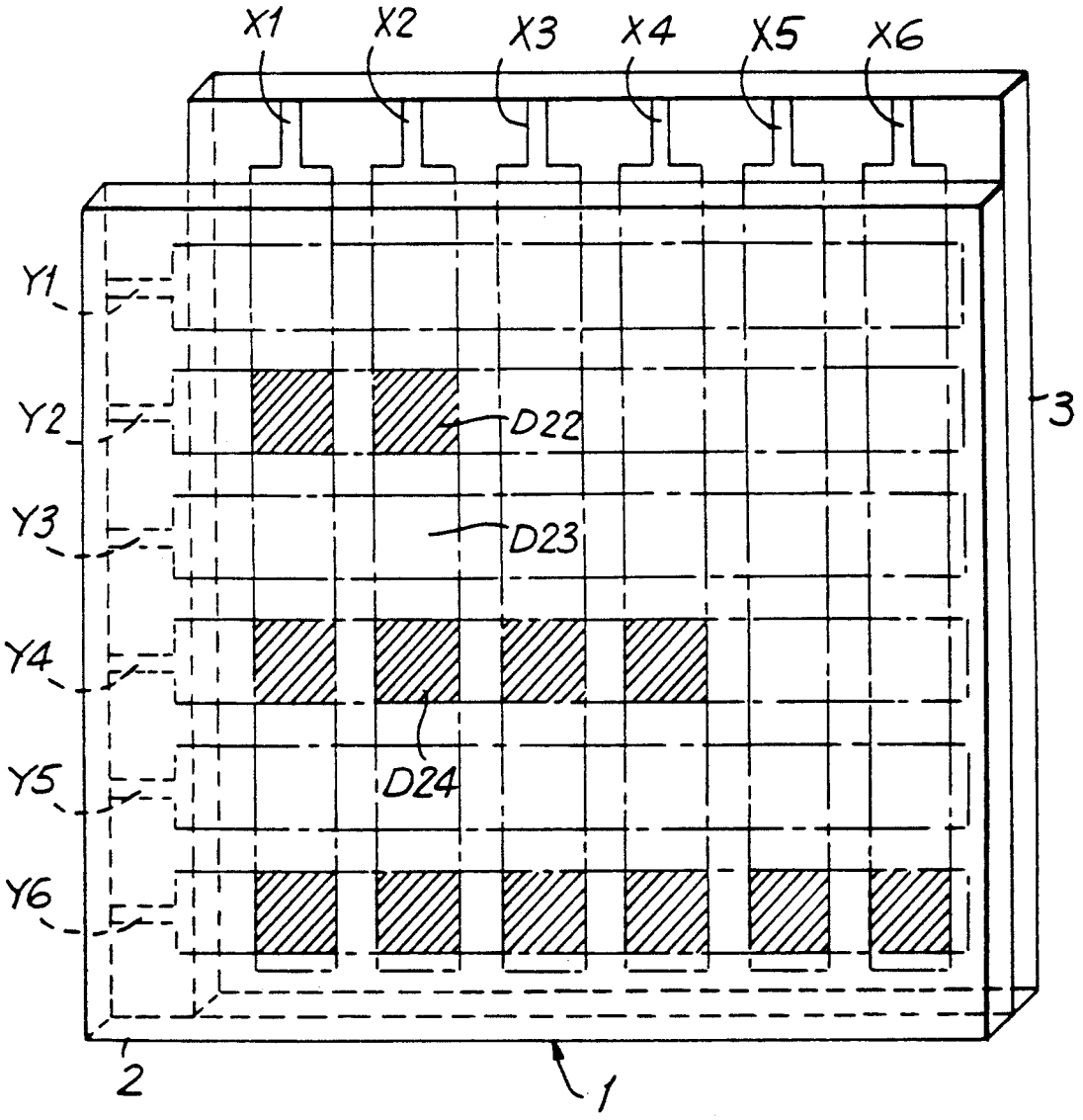
FIG. 17 PRIOR ART
Figure 18A:
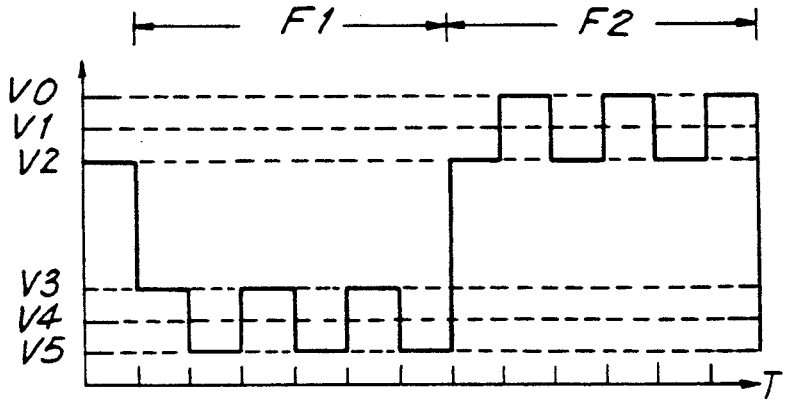
FIG.18(a) PRIOR ART
FIGS. 18(*a*)–18(*c*) and 19(*a*)–19(*c*) are voltage waveforms applied to the panel of FIG. 17 in the voltage averaging driving method in accordance with the prior art.
Figure 18B:
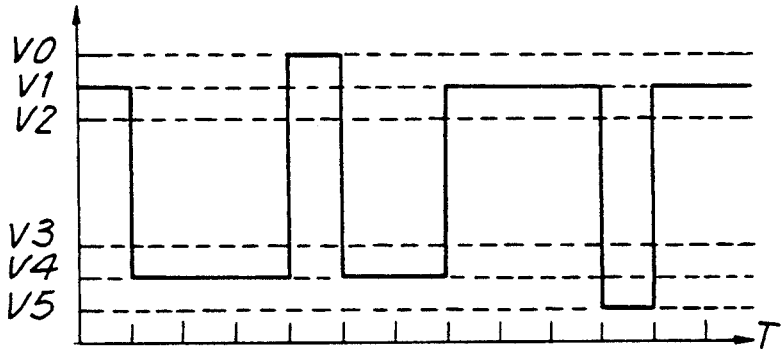
FIG.18(b) PRIOR ART
Figure 18C:
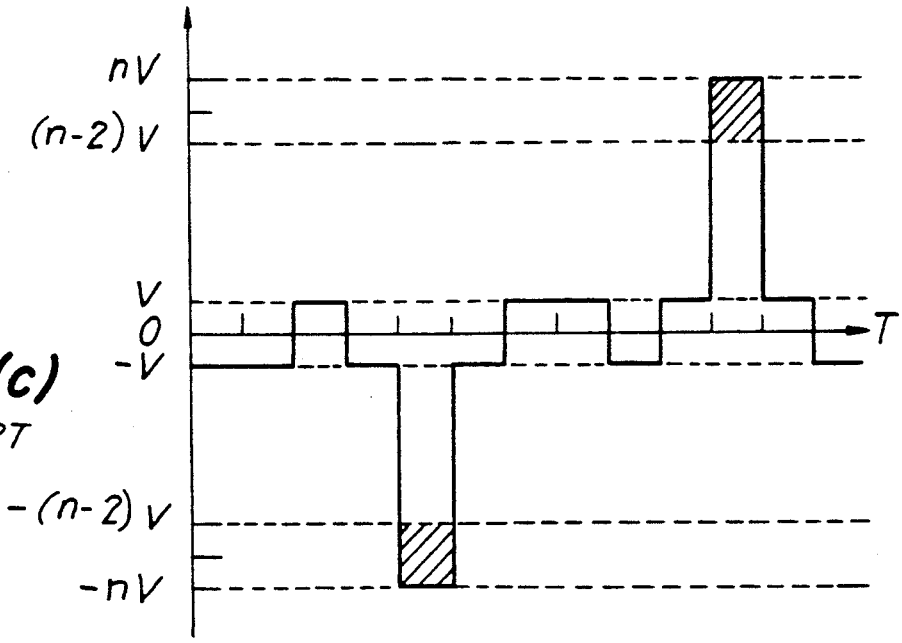
FIG.18(c) PRIOR ART
Figure 19A:
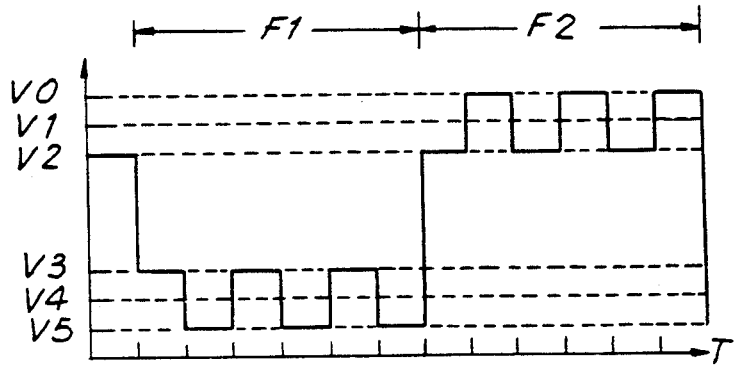
FIG.19(a) PRIOR ART
Figure 19B:
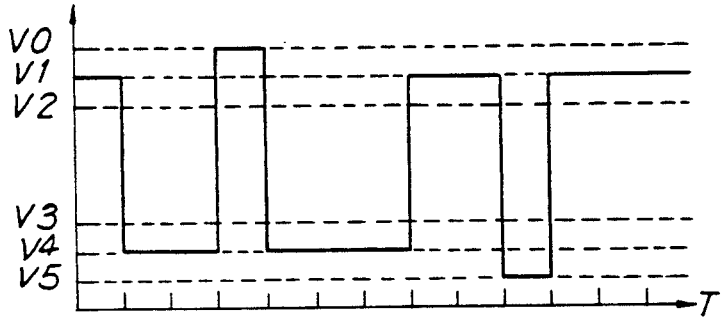
FIG.19(b) PRIOR ART
Figure 19C:
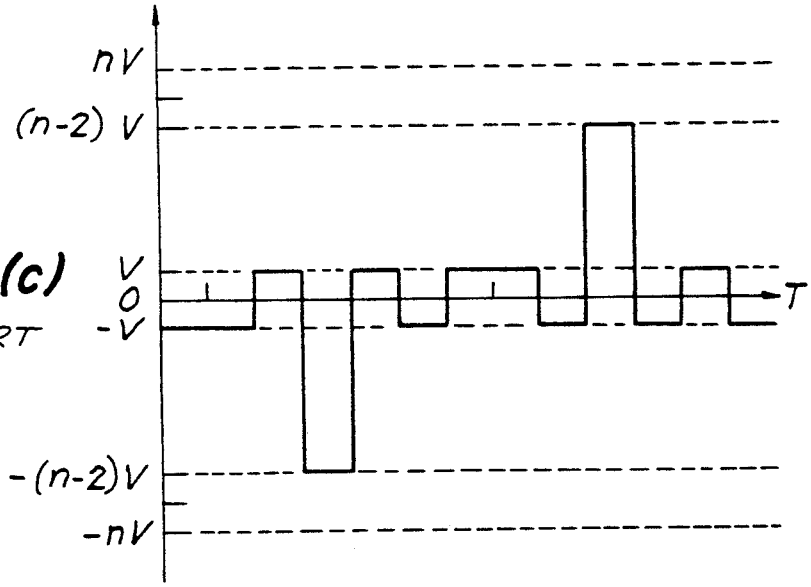
FIG.19(c) PRIOR ART
Figure 20A:
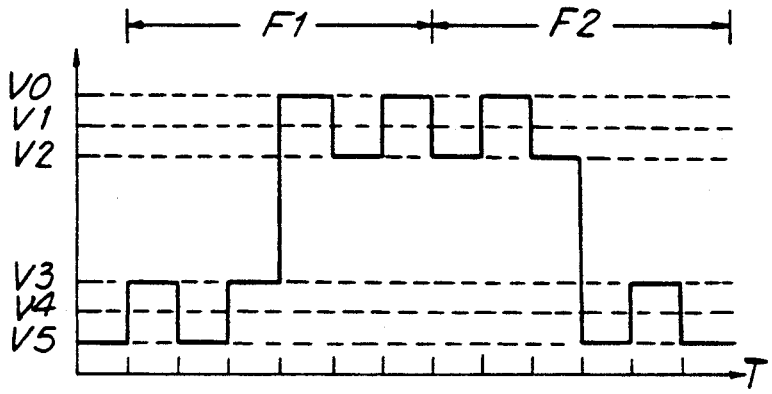
FIG. 20(a) PRIOR ART
FIGS. 20(*a*)–20(*c*) and 21(*a*)–21(*c*) are voltage waveforms applied to the panel of FIG. 17 in the line inversion method in accordance with the prior art.
Figure 20B:
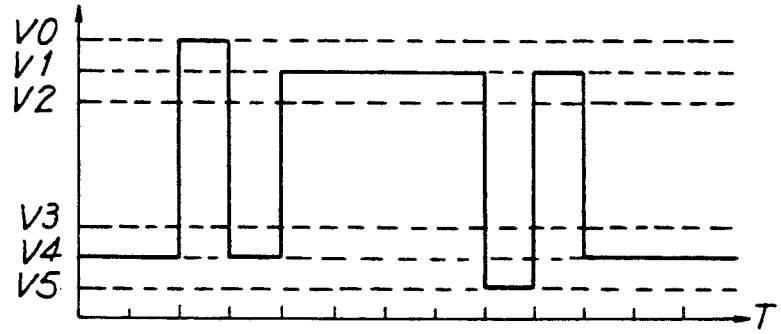
FIG. 20(b) PRIOR ART
Figure 20C:
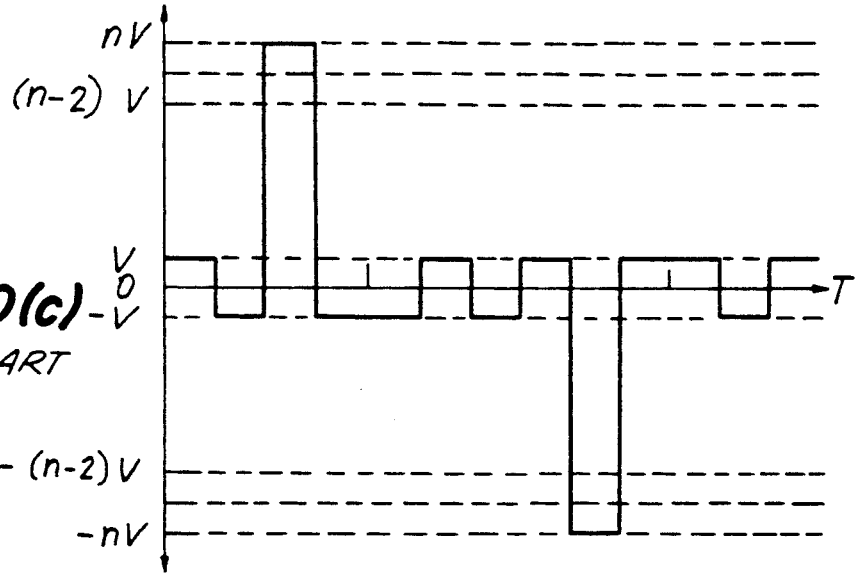
FIG. 20(c) PRIOR ART
Figure 21A:
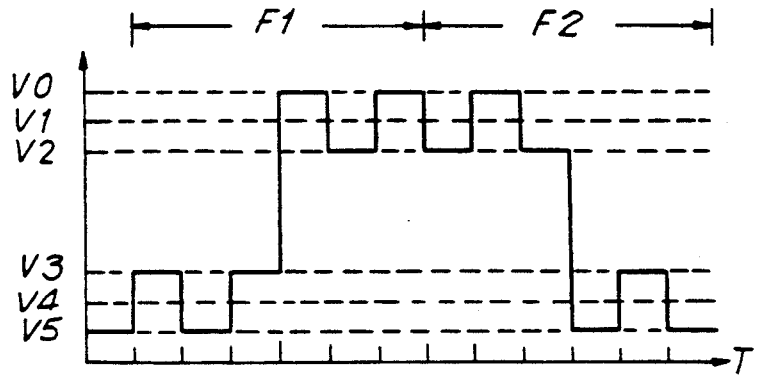
FIG. 21(a) PRIOR ART
Figure 21B:
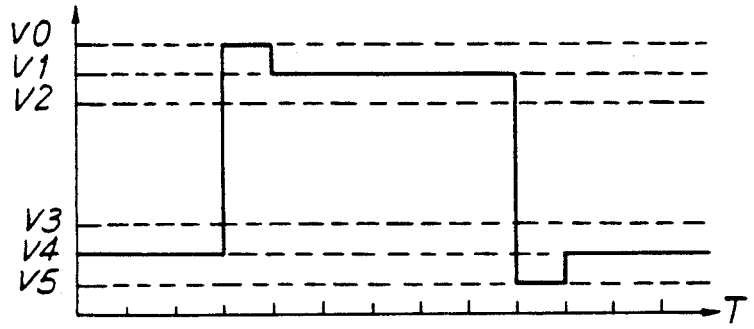
FIG. 21(b) PRIOR ART
Figure 21C:
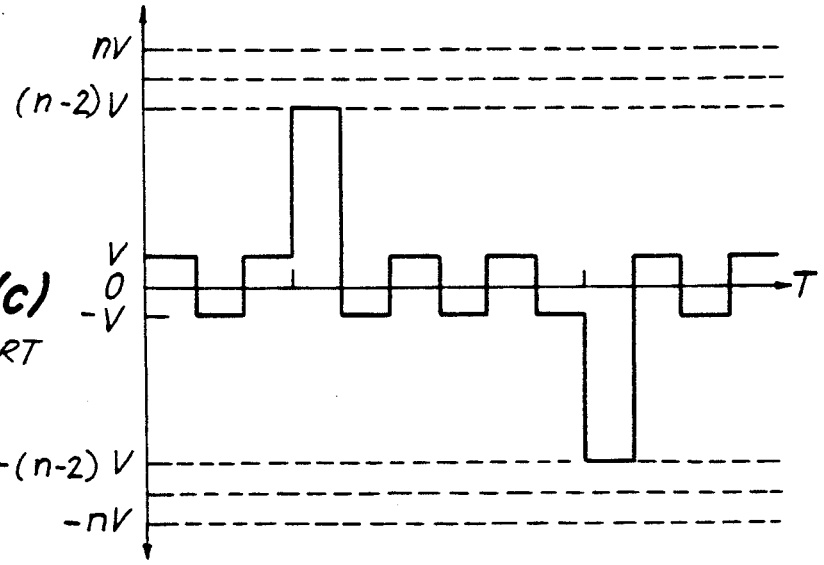
FIG. 21(c) PRIOR ART
Figure 22:
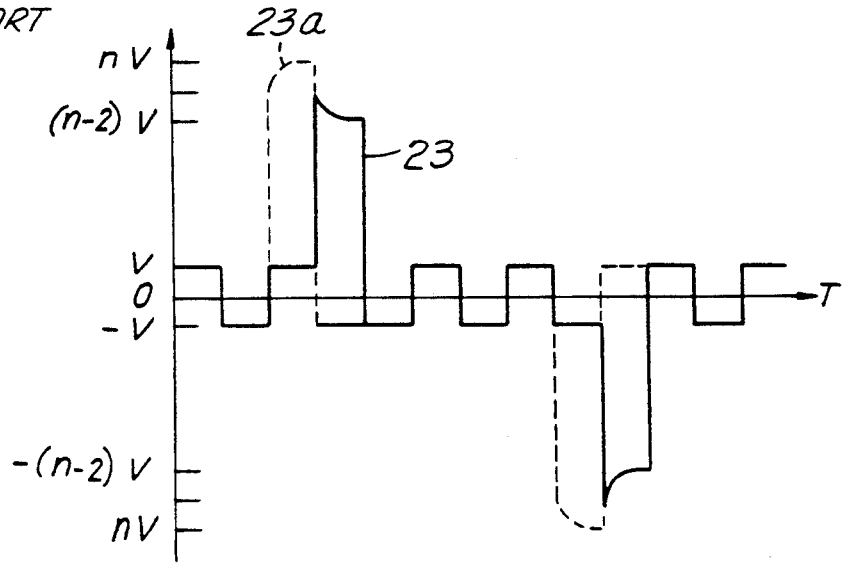
FIG. 22 PRIOR ART
FIG. 22 is a waveform of voltage applied to an element on the line inversion method of FIGS. 20 and 21.
Figure 23:
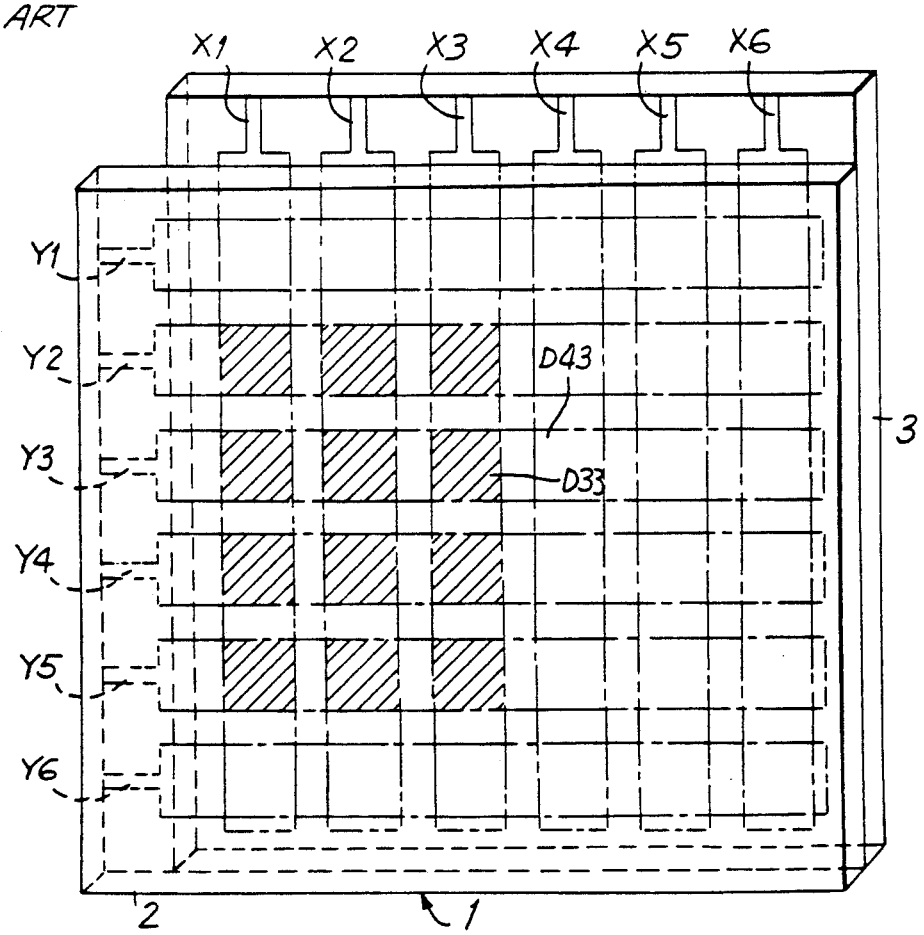
FIG. 23 PRIOR ART
Figure 24A:
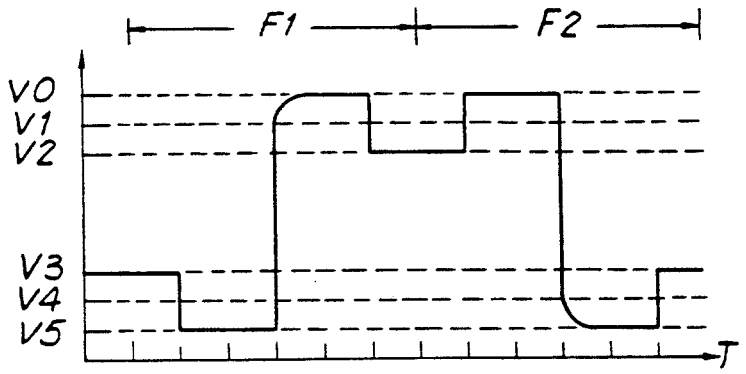
FIG. 24(a) PRIOR ART
FIGS. 24(*a*)–24(*c*) and 25(*a*)–25(*c*) are voltage waveforms applied to elements in the display illustrated in FIG. 23.
Figure 24B:
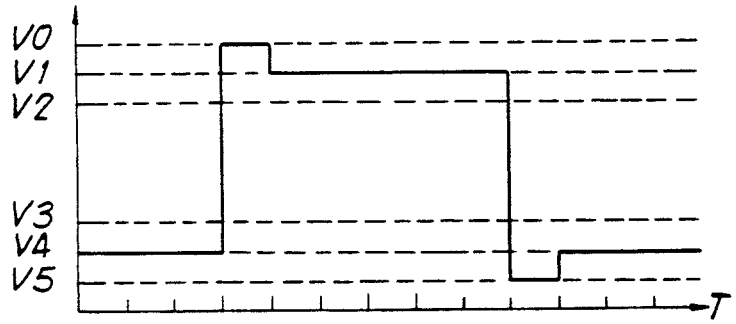
FIG. 24(b) PRIOR ART
Figure 24C:
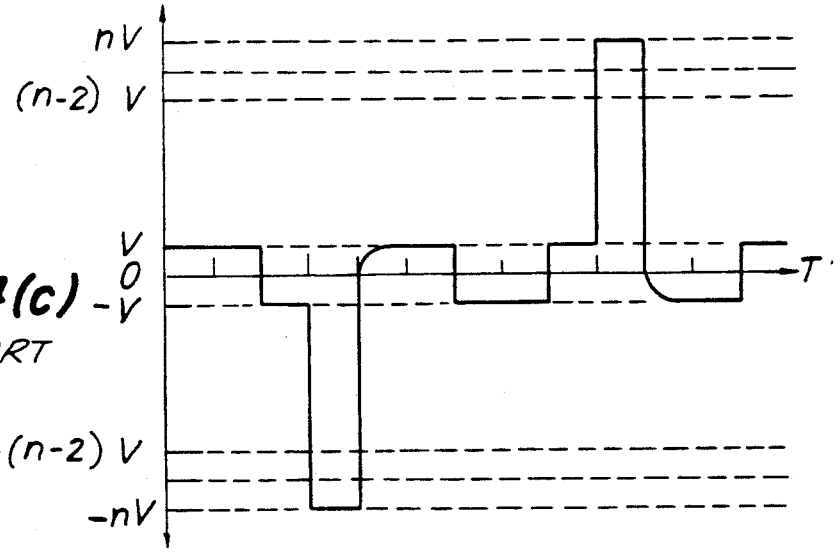
FIG. 24(c) PRIOR ART
Figure 25A:
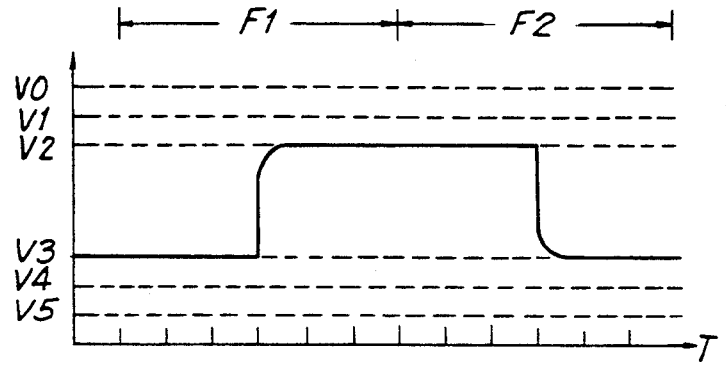
FIG. 25(a) PRIOR ART
Figure 25B:
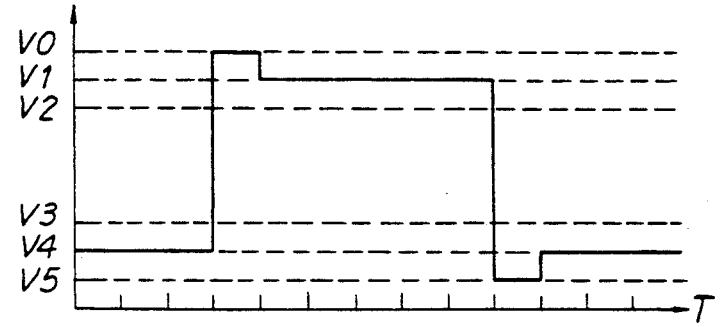
FIG. 25(b) PRIOR ART
Figure 25C:
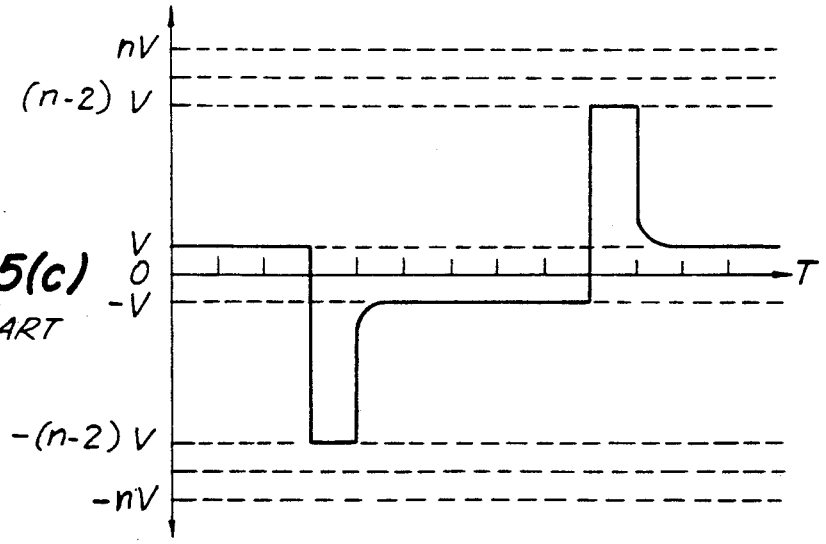
FIG. 25(c) PRIOR ART

FIGS. 14(*a*) through 14(*c*) illustrate the driving voltage waveforms in accordance with this embodiment of the invention when performing the display illustrated therein. The polarity is inverted between scanning electrodes Y3 and Y4. The number and locations of polarity inversions are not limited but may be selected arbitrarily as the necessity arises.

FIG. 14(*a*) is voltage waveform applied to signal electrode X3. The voltage waveform is urged towards the selective voltage when inverting the polarity. The correction voltage, which is subtracted from the non-selective voltage of V1N or V4N, is applied for a time period W immediately after polarity inversion and is required to compensate for uneven display contrast arising from the display contents. FIG. 14(*b*) is the voltage waveform applied on scanning electrode Y3, a correction non-selective voltage which deviates from the non-selective voltage to the selective voltage only during the time period obtained by adding the designated time to the time corresponding to a sum F of lit elements on the scanning electrodes Y3 and Y4 when inverting the polarity.

FIG. 14(*c*) shows the difference of waveform voltages between FIGS. 14(*a*) and 14(*b*) which is applied across element D33 which corresponds to the intersection of signal electrode X3 and scanning electrode Y3. The voltage waveform applied to scanning electrode Y3 also leans towards the selective voltage when the voltage waveform on signal electrode X3 is urged (i.e., dragged) towards the lighting voltage. As a result, the effective value of the difference is substantially corrected, thereby obviating contrast unevenness on the display.

Thus, the correction non-selective voltage is applied to the scanning electrode, selected just before inverting the polarity, when the polarity is inverted only for a time period (hereinafter referred to as a correction period) obtained by adding the designated time to the time corresponding the sum F. The contrasting unevenness on the display is then eliminated.

EMBODIMENT 7

As in Embodiment 6, the period for application of the correction non-selective voltage is increased or decreased. In other words, the voltage differs from the non-selective voltage according to the sum F. However, the difference and period in potential with respect to the different voltage may also be increased or decreased according to the sum F. The foregoing different voltage may be replaced with waveforms assuming triangular and trapezoidal configurations and other waveforms expressed by exponential functions.

EMBODIMENT 8

In Embodiment 6, the amount of correction is increased or reduced according to the sum F. However, the increase or decrease depending on the sum F may be omitted. Instead, a correction non-selective voltage is impressed on the scanning electrode, selected just before inverting the polarity, when the polarity is inverted only for a time period to which the designated time is added. This arrangement considerably improves the unevenness of the display. The correction period is set particularly at one cycle of Signal LP, thereby simplifying the circuitry because switches 1209 and 1210 and power supply circuit 805 can be omitted.

EMBODIMENT 9

Embodiment 1 overcomes the unevenness in the display due to cross-talk when the selective voltage overlaps the correction voltage. Embodiment 6 overcomes unevenness in the display due to the display contents when the non-selective voltage overlaps the correction voltage. Accordingly, the unevenness in the display due to both causes may both be simultaneously obviated.

EMBODIMENT 10

Embodiments 1 through 9 may provide a liquid crystal display device displaying no unevenness even at ambient temperatures of a wide range by providing a means for changing the amount of correction according to the ambient temperatures.

As discussed above, contrast unevenness can be ameliorated by correcting the difference between the effective voltages generated when inverting the polarity while varying the scanning or signal voltage waveforms when the polarity is inverted. The unevenness in contrast can further be improved by an addition of a correction voltage corresponding to the numeric value F. Moreover, an improved contrast condition can be provided by varying the scanning or signal voltage waveforms in accordance with the numeric value I even in a situation other than the polarity inversion.

Uneven contrast in the display is, in particular, minimized by applying corrective non-selective voltages on the scanning electrode immediately after polarity inversion in which selective voltages are applied immediately before polarity inversion. It is also possible to minimize uneven contrast by applying non-selective voltages on the scanning electrode selected just before inverting the polarity, wherein the polarity is inverted for the time period obtained by adding the designated time to the time corresponding to the sum F.

It will thus be seen that the objects set forth above, among those made apparent from the preceding description, are efficiently attained and, since certain changes may be made in carrying out the above method (process) and in the article set forth without departing from the spirit and scope of the invention, it is intended that all matter contained in the above description and shown in the accompanying drawing(s) shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed:

1. A liquid crystal display device having a plurality of picture elements which can be placed in lit and unlit states, comprising:

a first substrate;

a second substrate spaced apart from said first substrate;

a plurality of scanning electrodes and signal electrodes;

liquid crystal material disposed in the space between the substrates;

driving means for producing scan voltage waveforms and signal voltage waveforms, for supplying said scan voltage waveforms and signal voltage waveforms to said scanning electrodes and signal electrodes, respectively, whereby picture element voltages are applied across said picture elements, for periodically inverting the polarity of said scan voltage waveforms and signal voltage waveforms, and for producing at least one correction voltage combined with and for varying the voltage level of at least one of said scan voltage waveforms and signal voltage waveforms which are supplied to an associated picture element; and wherein said scan voltage waveforms include at least one select signal and at least one non-select signal, said at least one correction voltage being produced at a time when the corresponding scan voltage waveform of a picture element changes between a select signal and non-select signal at or following said scan voltage and signal voltage polarity inversion.

2. The liquid crystal display device of claim 1, wherein said plurality of scanning electrodes include a first scanning electrode and a second scanning electrode, said at least one select signal being next supplied to the second scanning electrode following application of said at least one selected signal to the first scanning electrode, and wherein said at least one correction voltage is based on a first number of lit picture elements associated with said first scanning electrode and a second number of lit picture elements associated with said second scanning electrode.

3. The liquid crystal display device of claim 2, wherein the width of the at least one correction voltage is based on the sum of said first number and said second number.

4. The liquid crystal display device of claim 7, wherein said driving means is further operable for producing at least one additional correction voltage for further combining with and varying the voltage level of at least one of said scan voltage waveforms and said signal voltage waveforms associated with said at least one picture element.

5. The liquid crystal display device of claim 4, wherein said at least one additional correction voltage is also based on the first number and the second number.

6. The liquid crystal display device of claim 5, wherein the width of the at least one additional correction voltage is based on the difference between said first number and said second number.

7. The liquid crystal display device of claim 1, wherein said driving means is further operable for producing at least one additional correction voltage for further varying the voltage level of at least one of said scan voltage waveforms and said signal voltage waveforms associated with at least one picture element.

8. The liquid crystal display device of claim 8, wherein said plurality of scanning electrodes includes a first scanning electrode and a second scanning electrode, said at least one select signal being next applied to the second scanning electrode following application of said at least one select signal to the first scanning electrode, and wherein said at least one additional correction voltage is based on a first number of lit picture elements associated with said first scanning electrode and a second number of lit picture elements associated with said second scanning electrode.

9. The liquid crystal display device of claim 8, wherein the width of the at least one additional correction voltage is based on the difference between said first number and said second number.

10. A method for producing a pattern to be displayed on a liquid crystal display device having a plurality of picture elements which can be placed in lit and unlit states, comprising:

producing scan voltage waveforms and signal voltage waveforms;

supplying said scan voltage waveforms and signal voltage waveforms to a plurality of scanning electrodes and signal electrodes, respectively;

applying picture element voltages across said picture elements;

periodically inverting the polarity of said scan voltage waveforms and said signal voltage waveforms;

producing at least one correction voltage for combining with and varying the voltage level of at least one of the scan voltage waveforms and signal voltage waveforms which are supplied to an associated picture element; and wherein the scan voltage waveforms include at least one select signal and at least one non-select signal, said at least one correction voltage being produced at a time when the corresponding scan voltage waveform of a picture element changes between a select signal and non-select signal at or following said scan voltage waveform and signal voltage waveform polarity inversion.

11. The method of claim 10, wherein the plurality of scanning electrodes includes at least a first scanning electrode and a second scanning electrode, the at least one select signal being next supplied to the second scanning electrode following application of the at least one select signal to the first scanning electrode, and wherein the at least one correction voltage is based on a first number of lit picture elements associated with the first scanning electrode and a second number of lit picture elements associated with the second scanning electrode.

12. The method of claim 11, wherein the width of the at least one correction voltage is based on the sum of the first number and the second number.

13. The method of claim 11, further including producing at least one additional correction voltage for further varying the voltage level of at least one of said scan voltage waveforms and said signal voltage waveforms of said associated picture element, wherein the width of the at least one additional correction voltage is based on the difference of the first number and the second number.

14. A liquid crystal display device having a plurality of picture elements which can be placed in lit and unlit states, comprising:

a first substrate;

a second substrate spaced apart from said first substrate;

a plurality of scanning electrodes and signal electrodes;

liquid crystal material disposed in the space between the substrates;

driving means for producing scan voltage waveforms and signal voltage waveforms, for supplying said scan voltage waveforms and signal voltage waveforms to said scanning electrodes and signal electrodes, respectively, whereby picture element voltages are applied across said picture elements, for periodically inverting the polarity of said scan voltage waveforms and said signal voltage waveforms and for producing at least one correction voltage combined with and for varying the voltage level of at least one of said scan voltage waveforms and signal voltage waveforms which are supplied to an associated picture element;

wherein said scan voltage waveforms include at least one select signal and at least one non-select signal, said at least one correction voltage being produced at a time immediately following a change in the voltage level of the signal voltage waveform corresponding to the associated picture element and at that same time the corresponding scan voltage waveform changes between a select signal and non-select signal; and wherein said plurality of scanning electrodes includes a first scanning electrode and a second scanning electrode, the at least one select signal being next supplied to the second scanning electrode following application of the at least one select signal to the first scanning electrode, and wherein said at least one correction voltage is based on a first number of lit picture elements associated with said first scanning electrode and a second number of lit picture elements associated with said second scanning electrode.

15. The liquid crystal display device of claim 14, wherein the width of the at least one correction voltage is based on the sum of said first number and said second number.

16. The liquid crystal display device of claim 15, wherein said driving means is further operable for producing at least one additional correction voltage for further combining with and varying the voltage level of at least one of said scan voltage waveforms and said signal voltage waveforms associated with said at least one picture element.

17. The liquid crystal display device of claim 16, wherein said at least one additional correction voltage is also based on the first number and the second number.

18. The liquid crystal display device of claim 17, wherein the width of the at least one additional correction voltage is based on the difference between said first number and said second number.

19. A method for producing a pattern to be displayed on a liquid crystal display device having a plurality of picture elements which can be placed in lit and unlit states, comprising:

producing scan voltage waveforms and signal voltage waveforms;

supplying said scan voltage waveforms and signal voltage waveforms to a plurality of scanning electrodes and signal electrodes respectively;

applying picture element voltages across said picture elements;

periodically inverting the polarity of the picture element voltages; and producing at least one correction voltage for combining with and varying the voltage level of at least one of the scan voltage waveforms and signal voltage waveforms which are supplied to an associated picture element;

wherein the scan voltage waveforms include at least one select signal and at least one non-select signal, said at least one correction voltage being produced at a time immediately following a change in the voltage level of the associated signal voltage waveform and at that same time the corresponding scan voltage waveform changes between a select signal and non-select signal; and wherein the plurality of scanning electrodes includes a first scanning electrode and a second scanning electrode, the at least one select signal being next supplied to the second scanning electrode following application of the at least one select signal to the first scanning electrode, and wherein the at least one correction voltage is based on a first number of lit picture elements associated with the first scanning electrode and a second number of lit picture elements associated with the second scanning electrode.

20. The method of claim 19, wherein the width of the at least one correction voltage is based on the sum of the first number and the second number.

21. The method of claim 19, further including producing at least one additional correction voltage for further varying the voltage level of at least one of said scan voltage waveforms and signal voltage waveforms of said associated picture element wherein the width of the at least one additional correction voltage is based on the difference of the first number and the second number.

* * * * *